US010496004B2

(12) United States Patent
Seki et al.

(10) Patent No.: US 10,496,004 B2
(45) Date of Patent: Dec. 3, 2019

(54) IMAGE FORMING APPARATUS WITH CURRENT-CONTROLLED LIGHT EMITTING ELEMENT

(71) Applicant: CANON KABUSHIKI KAISHA, Tokyo (JP)

(72) Inventors: Yuichi Seki, Saitama (JP); Satoru Takezawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 15/229,069

(22) Filed: Aug. 4, 2016

(65) Prior Publication Data

US 2017/0052473 A1 Feb. 23, 2017

(30) Foreign Application Priority Data

Aug. 20, 2015 (JP) ..... 2015-163243
Sep. 10, 2015 (JP) ..... 2015-178666

(51) Int. Cl.
*G03G 15/043* (2006.01)
*G03G 15/00* (2006.01)

(52) U.S. Cl.
CPC ..... *G03G 15/043* (2013.01); *G03G 15/80* (2013.01)

(58) Field of Classification Search
None
See application file for complete search history.

(56) References Cited

U.S. PATENT DOCUMENTS 4,908,634 A 3/1990 Arimoto et al. ..... 346/108
6,560,256 B1 5/2003 Seki et al. ..... 372/38.02
6,919,979 B2 7/2005 Seki et al. ..... 359/204.1
7,106,770 B2 9/2006 Seki ..... 372/43.01
7,129,967 B2 10/2006 Seki et al. ..... 347/249
7,277,113 B2 10/2007 Sobue et al. ..... 347/250
7,586,511 B2 9/2009 Seki et al. ..... 347/249
8,274,537 B2 9/2012 Okada ..... 347/236
8,665,303 B2 3/2014 Takezawa ..... 347/236
8,963,978 B2 2/2015 Seki ..... 347/237
8,982,168 B2 3/2015 Maeda et al. ..... G03G 15/043
9,091,955 B2 7/2015 Seki ..... G03G 15/04072
(Continued)

FOREIGN PATENT DOCUMENTS

JP S60-245364 12/1985
JP H01-202774 8/1989
(Continued)

OTHER PUBLICATIONS

Extended European Search Report dated Dec. 22, 2016 in counterpart European Application No. 16183925.3.
(Continued)

*Primary Examiner* — David M. Gray
*Assistant Examiner* — Geoffrey T Evans
(74) *Attorney, Agent, or Firm* — Venable LLP

(57) ABSTRACT

An image forming apparatus comprises a semiconductor laser for emitting laser light for irradiating a photosensitive drum, BD for detecting laser light before irradiating the photosensitive drum to output BD signal as a reference for determining an initiation position of the photosensitive drum, and a laser circuit board. The laser circuit board causes the semiconductor laser to emit laser light detected by the BD with first light amount. When a BD sensor outputs the BD signal, a laser circuit board causes the semiconductor laser to emit the laser light with second light amount.

14 Claims, 13 Drawing Sheets

(56) References Cited

U.S. PATENT DOCUMENTS

| | | | | |
|---|---|---|---|---|
| 9,841,699 | B2 | 12/2017 | Koga | G03G 15/043 |
| 2005/0094683 | A1 | 5/2005 | Holland | 372/24 |
| 2005/0212901 | A1 | 9/2005 | Sobue et al. | 347/246 |
| 2007/0216756 | A1 | 9/2007 | Komiya et al. | 347/246 |
| 2014/0347430 | A1 | 11/2014 | Maeda et al. | G03G 15/043 |
| 2015/0042739 | A1 | 2/2015 | Seki | G03G 15/043 |

FOREIGN PATENT DOCUMENTS

| | | |
|---|---|---|
| JP | H01-209871 | 8/1989 |
| JP | H04-121760 | 4/1992 |
| JP | 2001-138566 | 5/2001 |
| JP | 2005-064000 | 3/2005 |
| JP | 2005-280070 | 10/2005 |
| JP | 2009-292075 | 12/2009 |
| JP | 2013-139139 | 7/2013 |
| JP | 2014-228656 | 12/2014 |
| JP | 2015-033795 | 2/2015 |

OTHER PUBLICATIONS

U.S. Appl. No. 15/255,889, filed Sep. 2, 2016.
Office Action dated Dec. 18, 2018 in counterpart Korea Application No. 10-2016-0102693, together with English translation thereof.
Office Action dated Dec. 20, 2018 in counterpart Chinese Application No. 2016-1068897.0, together with English translation thereof.
JP Office Action dated May 7, 2019 in counterpart JP Application No. 2015-178666 with English translation.
KR Office Action dated Jun. 25, 2019 in counterpart KR Application No. 10-2016-0102693 with English translation.
JP Office Action dated Aug. 6, 2019 in counterpart JP Application No. 2015-163245 with English translation.

IMAGE FORMING APPARATUS WITH CURRENT-CONTROLLED LIGHT EMITTING ELEMENT

BACKGROUND OF THE INVENTION

Field of the Invention

The present disclosure relates to an electrophotographic image forming apparatus. In particular, the present disclosure relates to technology for controlling light amount of laser light used for image formation.

Description of the Related Art

The electrophotographic image forming apparatus performs image formation by irradiating a photoreceptor with laser light to form an electrostatic latent image and adhering developer to the electrostatic latent image. The laser light is output from an optical scanning apparatus comprising an exposure unit comprising a semiconductor laser, a rotating polygon mirror, f-θ lens etc. The semiconductor laser outputs the laser light. The laser light output from the semiconductor laser is periodically deflected by the rotating polygon mirror as the laser light and irradiates the photoreceptor through the f-θ lens. The laser light scans the photoreceptor according to the rotation of the rotating polygon mirror.

The optical scanning apparatus comprises a detection sensor for detecting the laser light (hereinafter, referred to as "BD (Beam Detector)". The BD receives the laser light before or after the laser light scans the photoreceptor. By receiving the laser light, the BD generates BD signals. The BD signal is used to control emitting timing of the laser light based on an image data in one scanning cycle. Further, the BD signal is used to define switching timing of control mode of a laser driver. United States Patent Application Publication No. 2005/212901 discloses an image forming apparatus, in which light amount of the laser light made incident on the BD to generate the BD signal becomes equal to that of the laser light which scans the photoreceptor.

The image forming apparatus disclosed in the United States Patent Application Publication No. 2005/212901, however, has following problems. FIG. 8 is a timing chart of light emission control of the semiconductor laser used for a conventional optical scanning apparatus. As shown in FIG. 8, there may be a case where the light amount of the laser light which scans the photoreceptor needs to be controlled to cope with a state change of the image forming apparatus main body when continuously forming images or to cope with a rapid environmental change of the image forming apparatus. At this time, as shown in FIG. 8, by changing a value of reference voltage Vref, the light amount of the laser light which scans the photoreceptor is controlled. Like the conventional image forming apparatus, if the light amount of the laser light made incident on the BD is equally set to the light amount of the laser light which scans the photoreceptor, the waveform of the BD signal varies before and after the control of the light amount. This causes a problem that a writing start position of the image differs before and after the control of the light amount. To solve this problem, an image forming apparatus capable of separately controlling the light amount of the laser light for generating the BD signal and the light amount of the laser light which scans the photoreceptor is desired.

SUMMARY OF THE INVENTION

According to the present disclosure, an image forming apparatus comprising: a photoreceptor; a semiconductor laser having light emitting element which emits laser light of a light amount corresponding to current supplied; a first light receiving element configured to receive laser light emitted from the light emitting element to generate light receiving signal of a voltage corresponding to light amount received for controlling the light amount of the laser light; a deflection unit configured to deflect the laser light to cause the laser light emitted from the light emitting element to scan the photoreceptor; a second light receiving element arranged on a scanning path of the laser light deflected by the deflection unit and is configured to generate a synchronization signal by receiving the laser light deflected by the deflection unit; a timing control unit configured to control emitting timing of the laser light based on an image data in one scanning cycle of the laser light based on a generation timing of the synchronization signal; an output unit configured to output a first reference voltage to control a light amount of the laser light which is incident on the second light receiving element and to output a second reference voltage to control a light amount of the laser light which scans the photoreceptor; a capacitor; a voltage control unit to which the light receiving signal and the first reference voltage or the second reference voltage are input, the voltage control unit configured to compare the voltage of the light receiving signal with the first reference voltage or the second reference voltage to control the voltage of the capacitor based on a comparison result; and a current supply unit configured to supply current corresponding to the voltage of the capacitor controlled by the voltage control unit to the light emitting element.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

(Embodiment 1)

Figure 1:
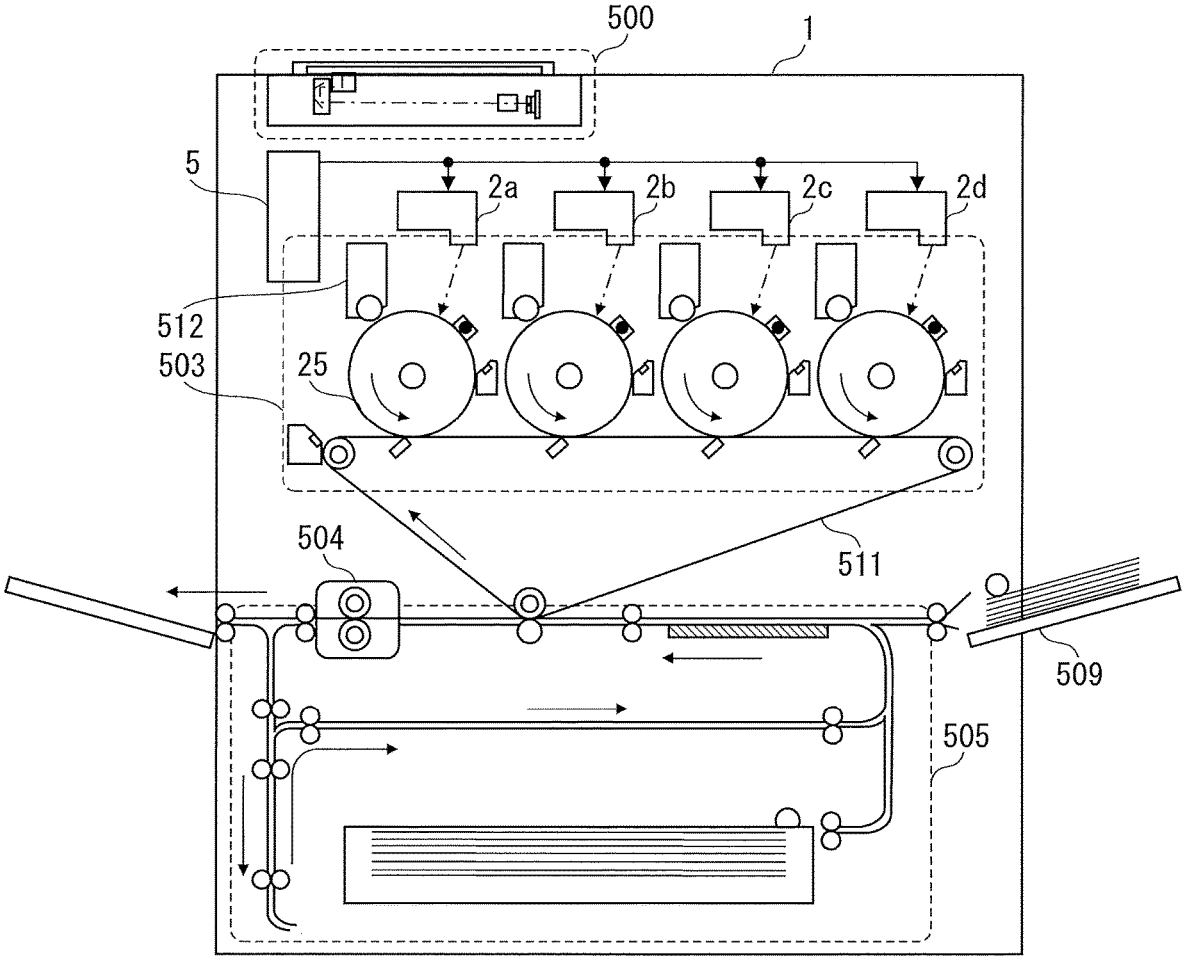
FIG. 1 is a configuration diagram of an image forming apparatus according to each embodiment.

FIG. 1 is a configuration diagram of an electrophotographic image forming apparatus. An image forming apparatus 1 is, for example, a copying machine or a multifunction peripheral. The image forming apparatus 1 includes a plurality of optical scanning apparatuses 2*a*, 2*b*, 2*c*, and 2*d*, a control unit 5 (controller), an image reading apparatus 500, an image forming unit 503, a fixing unit 504, a sheet feeding/conveying unit 505, and a manual feed tray 509. The image forming unit 503 includes a plurality of photosensitive drums 25, which are photoreceptors respectively corresponding to a plurality of the optical scanning apparatuses 2*a*, 2*b*, 2*c*, and 2*d*. The image forming unit 503 also includes a plurality of developing units 512 provided to correspond to each photosensitive drum 25. The image forming unit 503 also includes an intermediate transfer body 511.

The image reading apparatus 500 optically reads an original image by exposing light on an original placed on a platen and receiving its reflected light. The image reading apparatus 500 converts the received reflected light into electrical signals and outputs the electrical signals. The control unit processes the electrical signals output from the image reading apparatus 500 and generates the image data according to the original image. The control unit 5 controls light emission of the optical scanning apparatuses 2*a*, 2*b*, 2*c*, and 2*d* based on the generated image data.

The optical scanning apparatuses 2*a*, 2*b*, 2*c*, and 2*d* irradiate the corresponding photosensitive drum 25 with the laser light. The image forming unit 503 rotationally drives each photosensitive drum 25 and charges the surface of each photosensitive drum 25 with a charger. By irradiating the photosensitive drum 25, the surface of which is charged, with the laser light, an electrostatic latent image is formed on the surface of the photosensitive drum 25. The developing unit 512, storing toner as a developer, adheres the toner to the electrostatic latent image to perform development. Thereby, a toner image is formed on the photosensitive drum 25. A toner image of a different color is formed on each photosensitive drum 25. For example, the toner images of yellow, magenta, cyan, and black are formed on the photosensitive drum 25. The toner images formed on each photosensitive drum 25 are overlappingly transferred to the intermediate transfer body 511. Thereby, a full-color toner image is formed on the intermediate transfer body 511.

The sheet feeding/conveying unit 505 conveys sheet placed on a paper feeding cassette or the manual feed tray 509 to a position where contacts with the intermediate transfer body 511. The toner image formed on the intermediate transfer body 511 is transferred to the sheet. The sheet having the toner image transferred is conveyed to the fixing unit 504. The fixing unit 504 thermally pressurizes the toner image on the sheet. Due to this, the image is fixed on the sheet. The sheet having the image fixed is delivered outside the image forming apparatus 1. In the above mentioned manner, the image forming apparatus 1 performs the image forming processing.

Figure 2:
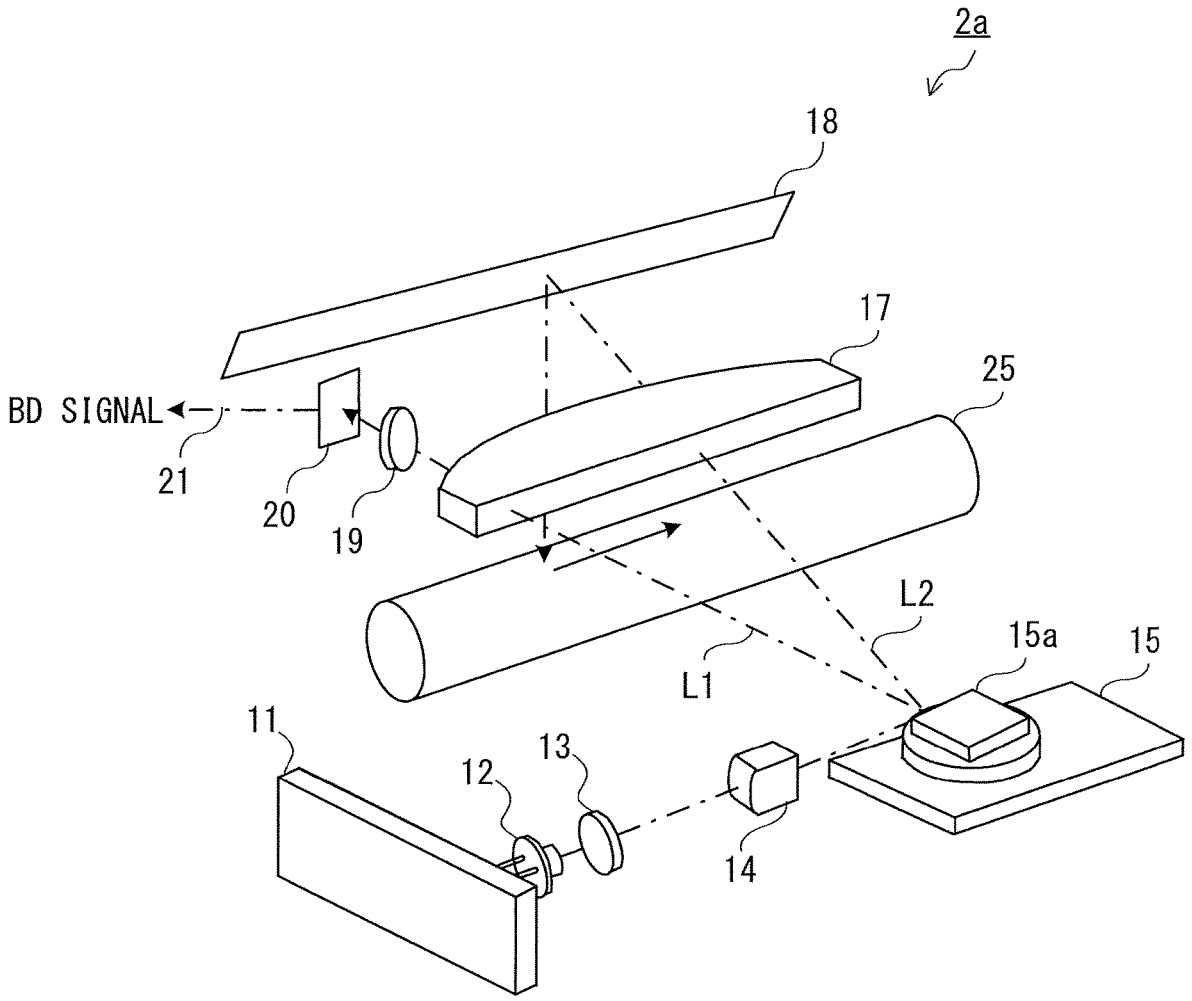
FIG. 2 is a configuration diagram of an exposure unit according to each embodiment.

FIG. 2 is a configuration diagram of the optical scanning apparatus 2*a*. The optical scanning apparatuses 2*a*, 2*b*, 2*c*, and 2*d* have the same configuration. Thereby, here, a description is provided with regard to the optical scanning apparatus 2*a* and the description with regard to the rest of the optical scanning apparatuses 2*b*, 2*c*, and 2*d* is omitted.

The optical scanning apparatus 2*a* comprises a laser circuit board 11, a semiconductor laser 12 for emitting the laser light, a collimate lens 13, a cylindrical lens 14, a rotating polygon mirror of a polygon mirror 15*a*, *f*-θ lens 17, a reflection mirror 18, a condensing lens 19, and BD 20.

A reference voltage generating circuit 33, a laser driver 30 and a semiconductor laser 12, which are described later, are mounted in the laser circuit board 11. The laser light emitted from LD 12*a* (described later) of the semiconductor laser 12 passes through the collimate lens 13 and the cylindrical lens 14 and is incident on a reflection surface of the polygon mirror 15*a*. The polygon mirror 15*a* is rotationally driven in a clockwise direction in FIG. 2 by a driving motor 15. The laser light is deflected in accordance with the rotation of the polygon mirror 15*a* so as to scan the photosensitive drum 25 in an arrow direction. The laser light deflected by the polygon mirror 15*a* is guided to the photosensitive drum 25 by passing through the f-θ lens 17 and being reflected by the reflection mirror 18.

The BD 20 (a first light receiving element) is arranged to receive the laser light which scans non-image area. The BD 20 receives laser light L1 which is deflected by the polygon mirror 15*a* through the f-θ lens 17 and the condensing lens 19. The BD 20 is photoelectric conversion elements and outputs BD signal 21 (or synchronization signal) which is a light receiving signal of a voltage corresponding to the light amount received. The BD signal 21 is input into the control unit 5. The control unit 5 converts the BD signal 21 into a pulse signal using threshold of a predetermined voltage. Then, based on the generation timing of the pulse signal, the control unit 5 performs emission timing control of the laser light based on the image data in each scanning period. The BD signal 21 is generated by the laser light respectively deflected to one or more reflection surfaces of the polygon mirror 15*a*. Thereby, if the rotation speed of the polygon mirror 15*a* is stabilized, the BD signal 21 is output at a constant period.

Figure 3:
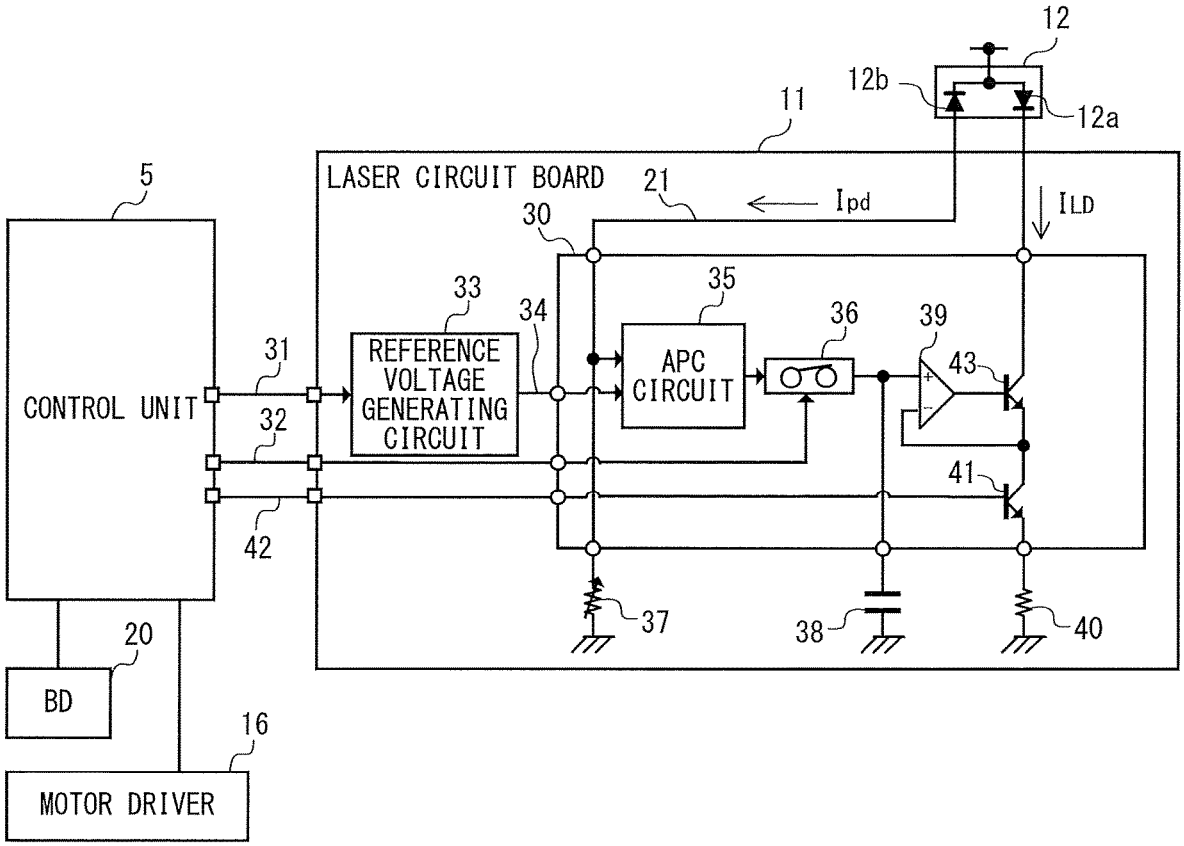
FIG. 3 is a configuration diagram of a laser circuit board according to an Embodiment 1.

FIG. 3 is a control block diagram for driving the semiconductor laser 12. The laser driver 30, the reference voltage generating circuit 33, a resistor 37, a capacitor 38, a resistor 40, and the semiconductor laser 12 are mounted in the laser circuit board 11. The laser driver 30 is a integrated circuit (laser driver IC). The laser circuit board 11 is connected to the control unit 5 by a cable. The control unit 5 is at least one integrated circuit (controller IC). The control unit 5 is mounted a controller circuit board which is different from the laser circuit board 11.

The semiconductor laser 12 comprises a laser diode (hereinafter, referred to as "LD") 12*a* which is a light emitting element which emits laser light. The semiconductor laser 12 also comprises a photo diode (a second light receiving element. hereinafter, referred to as "PD") 12*b* which is a light receiving element which receives the laser light emitted from the LD 12*a*. The LD 12*a* emits the laser light of the light amount corresponding to current $I_{LD}$ supplied from the laser driver 30. The PD 12*b* inputs current $I_{pd}$ corresponding to the light amount received into the laser driver 30. The semiconductor laser 12 of the present embodiment is an edge emitting semiconductor laser which emits laser light bidirectionally. The laser light which is emitted to one side by the semiconductor laser 12 is made incident on the collimate lens 13. The laser light which is emitted to the other side by the semiconductor laser 12 is made incident on the PD 12*b*. Further, the PD 12*b* may be disposed outside the semiconductor laser 12.

The laser driver 30 comprises an APC circuit 35 (voltage control circuit), a switch 36, a comparator 39, a transistor 41, and a transistor 43. PWM signal of a video signal 42 is input into the laser driver 30 from the control unit 5. The video signal 42 is a signal to turn ON/OFF the transistor 41. Thereby, for example, if the video signal 42 is in a "High" level, current $I_{LD}$ flows in the LD 12*a*. The LD 12*a* emits the laser light of the light amount corresponding to the current $I_{LD}$. On the other hand, if the video signal 42 is in a "Low" level, no current $I_{LD}$ flows in the LD 12*a*. The transistor 41 is a switch used to turn ON/OFF the LD 12*a*, which, substantially, does not comprise a current amplifying function.

A value of the current $I_{LD}$ is defined by a voltage of the capacitor 38 and a resistance value of the resistor 40. An anode terminal of the resistor 40 is connected to an emitter terminal of the transistor 41. The cathode terminal of the resistor 40 is grounded. A collector terminal of the transistor 41 is connected to an emitter terminal of the transistor 43. A base terminal of the transistor 43 is connected to an output terminal of the comparator 39.

The comparator 39, the transistor 43 and the resistor 40 function as a current supply circuit for supplying the current $I_{LD}$ to the LD 12*a*. The capacitor 38 is connected to a non-inverting terminal of the comparator 39. Thereby, voltage V+ of the non-inverting terminal of the comparator 39 is equal to the voltage of the capacitor 38. An inverting terminal of the comparator 39 is connected to the emitter terminal of the transistor 43 and the anode terminal of the resistor 40. Thereby, voltage V− of the inverting terminal of the comparator 39 is equal to the voltage of the anode terminal of the resistor 40.

The voltage V− of the inverting terminal of the comparator 39 is defined by the value of the current $I_{LD}$ and the resistor 40. Based on the comparison result between the voltage V+ of the non-inverting terminal and the voltage V− of the inverting terminal, the comparator 39 controls a base voltage of the transistor 43. It means that the base voltage of the transistor 43 is controlled so that it becomes the voltage corresponding to the voltage of the capacitor 38. The base voltage of the transistor 43 is controlled in this manner so that the voltage of the anode terminal of the resistor 40 is controlled. As a result, the value of the current $I_{LD}$ is controlled.

In the following, a description with regard to APC (Automatic Power Control) is provided. The APC is executed to control the light amount of the laser light emitted from the LD 12*a* to target light amount. It means that, the APC in the image forming apparatus 1 of the present embodiment is executed to control the voltage of the capacitor 38 to the voltage corresponding to the target light amount. The image forming apparatus 1 of the present embodiment sets one or more target light amounts. One of the target light amounts is the target light amount of the laser light made incident on the BD 20 (a first target light amount). Further, the other target light amount is the target light amount of the laser light which scans the photosensitive drum 25 (a second target light amount). The APC of the present embodiment is a sequence separately executed in one scanning period of the laser light for controlling the light amount of the laser light to the first target light amount and to the second target light amount. The image forming apparatus 1 of the present embodiment separately executes the APC for controlling the laser light to the first target light amount (a first light amount control mode, described later) and the APC for controlling the laser light to the second target light amount (a second light amount control mode, described later) one time in one scanning period of the laser light.

When executing the APC, the control unit 5 connects the switch 36 by a sample hold signal 32. The control unit 5 outputs a voltage setting signal 31 which corresponds to the target light amount of the laser light emitted from the LD 12*a*. In the present embodiment, the voltage setting signal 31 is PWM (Pulse Width Modulation) signal. The control unit 5 outputs the video signal 42 which is the PWM signal having pulse width which corresponds to the target light amount of the laser light.

Figure 4A:
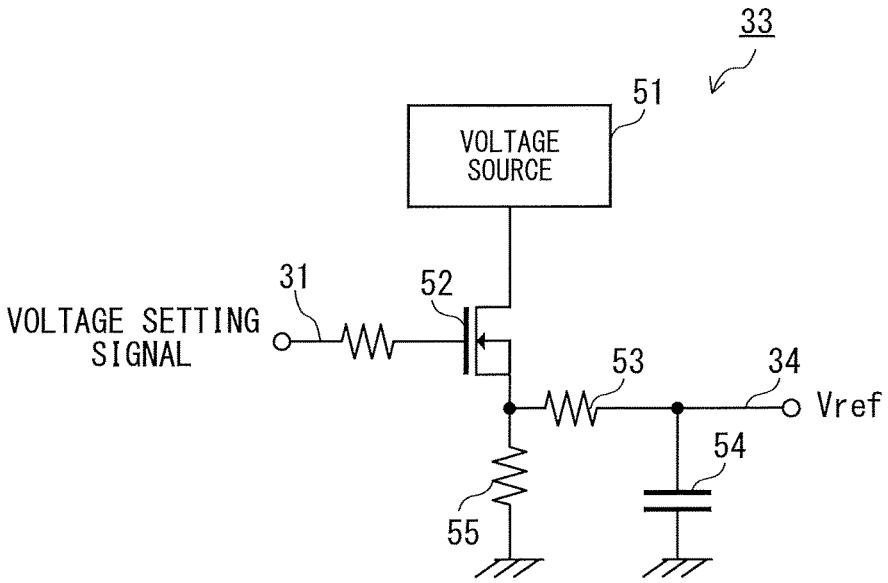
FIGS. 4A and 4B are explanatory diagrams of reference voltage generating circuits according to each embodiment.

FIG. 4A is a diagram illustrating a configuration of a circuit of the reference voltage generating circuit 33. Further, the reference voltage generating circuit 33 may be disposed inside the laser driver 30 or inside the control unit 5. The reference voltage generating circuit 33 comprises FET (Field Effect Transistor) 52. A drain terminal of the FET 52 is connected to a voltage source 51 which outputs a fixed voltage (for example, 5 V). A gate terminal of the FET 52 is connected to the control unit 5. The voltage setting signal 31 is input into the gate terminal of the FET 52 from the control unit 5. A source terminal of the FET 52 is connected to one terminal of a resistor 53 and one terminal of a resistor 55. The other terminal of the resistor 55 is grounded. The other terminal of the resistor 53 is connected to a capacitor 54.

The FET 52 executes switching operation to connect or release the drain terminal and the source terminal by the PWM signal of the voltage setting signal 31 which is input into the gate terminal. When the FET 52 turns ON, the voltage of the source terminal of the FET 52 is 5 V, which is the voltage output from the voltage source 51. On the other hand, when the FET 52 turns OFF, the voltage of the source terminal of the FET is 0 V. Thereby, in accordance with duty ratio of the PWM signal (voltage setting signal 31), the voltage of the source terminal of the FET 52 takes two values, 5 V and 0 V.

Figure 4B:
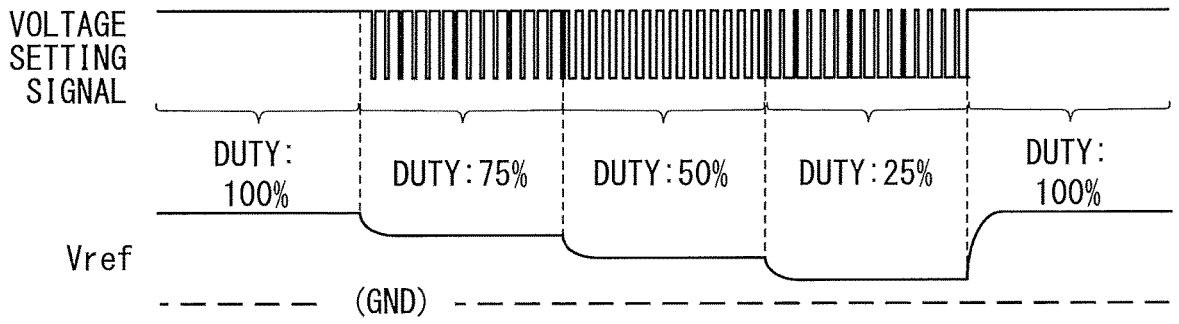

The resistor 53 and the capacitor 54 are electronic components comprising of a smoothing circuit. The smoothing circuit outputs the voltage of the source terminal which varies by the switching operation of the FET 52 as smoothed reference voltage Vref 34. For example, as shown in FIG. 4B, if the duty ratio of the PWM signal (voltage setting signal 31) which is input into the gate terminal of the FET 52 is 100%, the reference voltage Vref 34 is 5 V. If the duty ratio of the PWM signal (voltage setting signal 31) which is input into the gate terminal of the FET 52 is 50%, the reference voltage Vref 34 is 2.5 V. If the duty ratio of the PWM signal (voltage setting signal 31) which is input into the gate terminal of the FET 52 is 20%, the reference voltage Vref 34 is 1 V. By controlling the pulse width of the PWM signal (voltage setting signal 31) in this manner, the reference voltage Vref 34 can be controlled to the target value. The reference voltage Vref 34 generated by the reference voltage generating circuit 33 is input into the APC circuit 35 which is incorporated in the laser driver 30.

When executing the APC, the control unit 5 sets the PWM signal of the video signal 42 to the High level. Due to this, the current $I_{LD}$ corresponding to the voltage of the capacitor 38 flows in the LD 12*a*. The LD 12*a* emits the laser light of the light amount corresponding to the current $I_{LD}$. In response to receiving the laser light, the PD 12*b* outputs the current $I_{pd}$ (light receiving signal) corresponding to the light amount received. The PD 12*b* is connected to the resistor 37 and the APC circuit 35. The current $I_{pd}$ flows in the ground through the resistor 37. The voltage $V_{pd}$ of the anode of the resistor 37 is defined by the current $I_{pd}$ and the resistance value of the resistor 37. The voltage $V_{pd}$ is input into the APC circuit 35. It means that, by outputting, by the PD 12*b*, the current $I_{pd}$, the voltage $V_{pd}$ is generated.

The APC circuit 35 incorporates a comparator (not shown) for comparing the reference voltage Vref with the voltage $V_{pd}$. Based on the comparison result between the reference voltage Vref and the voltage $V_{pd}$, the APC circuit 35 controls the voltage of the capacitor 38. It means that, if the reference voltage Vref is more than the voltage $V_{pd}$ (reference voltage Vref>voltage $V_{pd}$), the APC circuit 35 charges the capacitor 38 to increase the voltage of the capacitor 38. On the other hand, if the reference voltage Vref is less than the voltage $V_{pd}$ (reference voltage Vref<voltage $V_{pd}$), the APC circuit 35 discharges charges from the capacitor 38 to decrease the voltage of the capacitor 38. If the reference voltage Vref is equal to the voltage $V_{pd}$ (reference voltage Vref=voltage $V_{pd}$), the APC circuit 35 maintains the voltage of the capacitor 38.

When the APC ends, the control unit 5 releases the connection of the switch 36 by the sample hold signal 32. By the release of the switch 36, the voltage of the capacitor 38 is held.

In this manner, by executing, by the laser driver 30, the APC, the light amount of the laser light emitted from the LD 12*a* can be controlled to the target light amount. Normally, regardless of the video signal 42, a bias current is supplied to the LD 12*a* during the image formation as a standby current. However, to simplify description, a description with regard to the bias current is omitted in the present embodiment.

The reference voltage generating circuit 33 may be provided in the control unit 5. Further, if the voltage setting signal 31 is serial/parallel n bit digital signal (n is an integer of 2 or more), the reference voltage generating circuit 33 may execute digital-to-analog conversion of the voltage setting signal 31 to generate the reference voltage Vref 34.

Next, a description with regard to a control mode of the laser driver 30 after starting up the optical scanning apparatus 2*a* is provided. The control unit 5 switches the control mode of the optical scanning apparatus 2*a* with falling of the BD signal 21 as a starting point. The control mode of the laser driver 30 of the present embodiment includes a stop (DISCHARGE) mode, a first light amount control mode (APC (1)), a second light amount control mode (APC (2)), an OFF mode, and a VDO mode. To switch the control mode, the control unit 5 outputs control signals in three bits (not shown) respectively corresponding to the five modes to the laser driver 30. By receiving the control signals, the laser driver 30 switches the control mode.

The DISCHARGE mode is a standby mode in a state in which no job for image formation is input. The first light amount control mode is a mode executed to control the light amount of the laser light which is incident on the BD 20 to the target light amount. The second light amount control mode is a mode executed to control the light amount of the laser light which scans the photosensitive drum 25 to the target light amount. The OFF mode is a mode to control the transistor 41 to OFF to prevent the laser light from being emitted from the LD 12*a*. The VDO mode is a mode in which scanning of photosensitive drum 25 by the laser light based on the image data is executed. The light amount of the laser light which scans the photosensitive drum 25 is set in the second light amount control mode. In the following, descriptions with regard to each mode are provided.

Figure 5A:
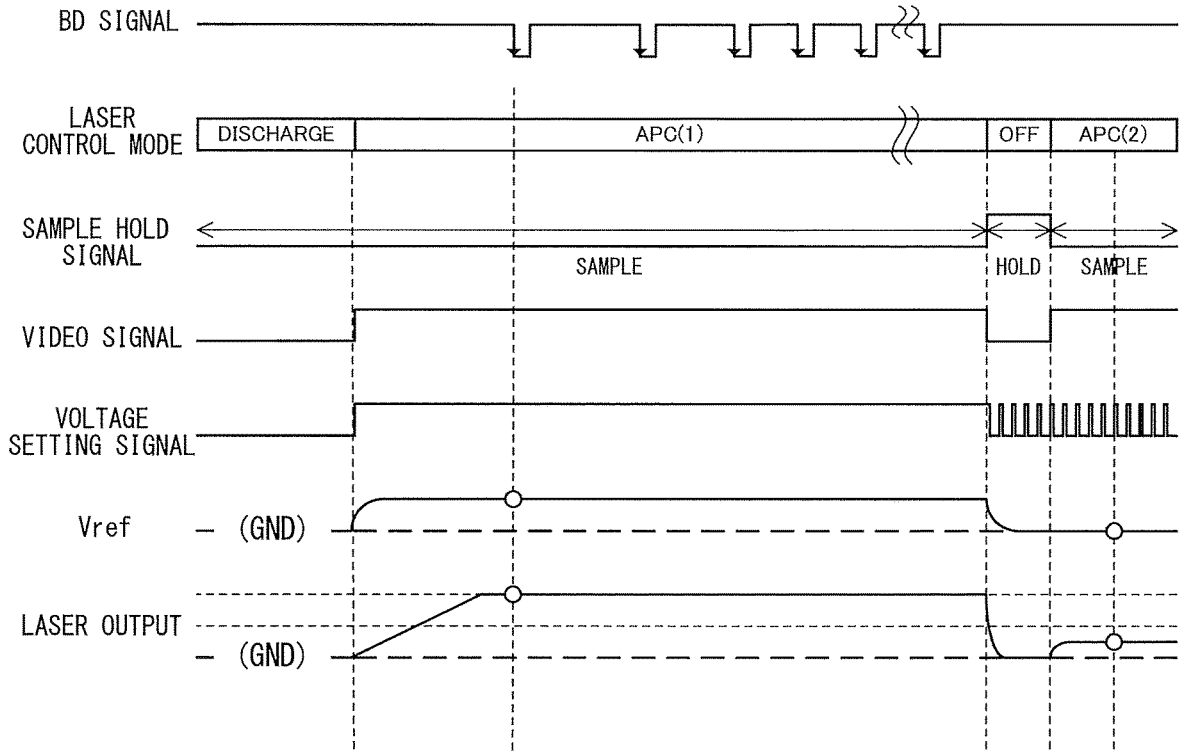
FIGS. 5A and 5B are timing charts of light emission control of semiconductor laser by the laser circuit board according to the Embodiment 1.
Figure 5B:
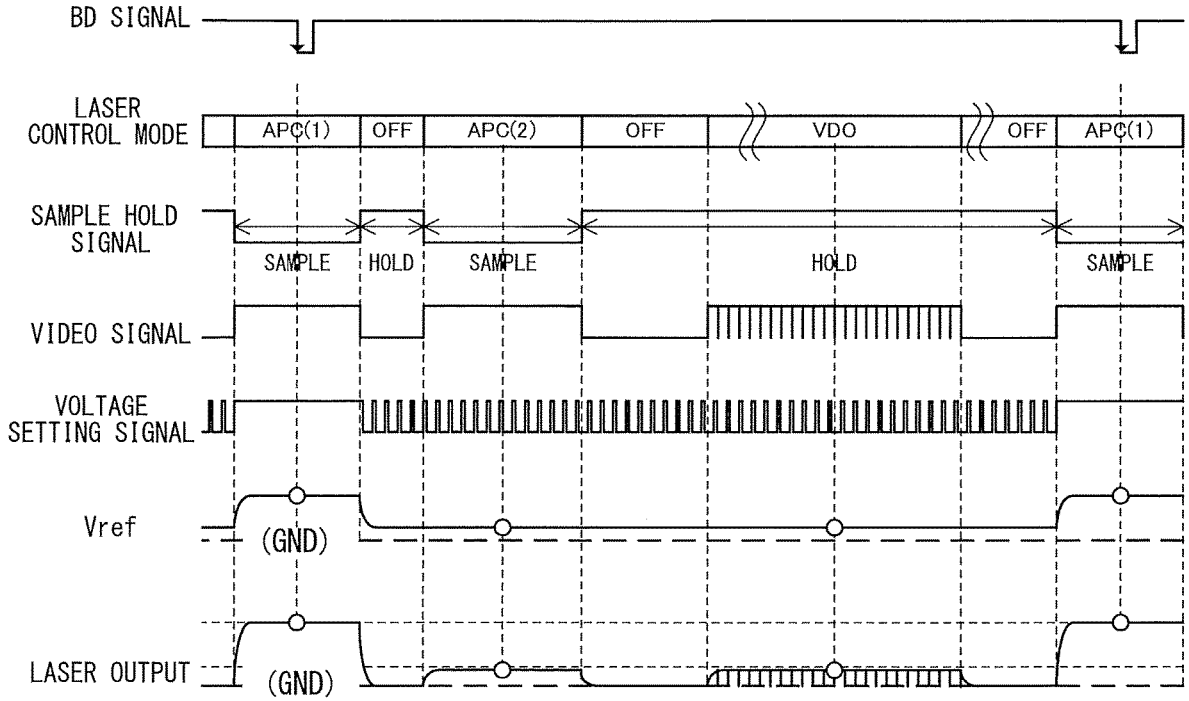

FIGS. 5A and 5B are timing charts showing a control state of the laser circuit board 11. FIG. 5A represents a timing chart when starting up the optical scanning apparatus 2*a*. FIG. 5B is represents a timing chart of one scanning period of the laser light during the image formation. Following FIG. 5A, processing in accordance with the timing chart of FIG. 5B is executed. The control state of the laser driver 30 is switched by the control unit 5 with the falling of the BD signal 21 as a starting point.

Before starting up the optical scanning apparatus 2*a*, the control unit 5 sets the control mode of the laser driver 30 in the stop (DISCHARGE) mode. In the DISCHARGE mode, no charge is accumulated in the hold capacitor 38. By the input of the image data into the image forming apparatus 1, the control unit 5 transmits an acceleration signal to a motor driver 16 to start the rotation of the polygon mirror 15*a* of the optical scanning apparatus 2*a*. When starting up the optical scanning apparatus 2*a*, the control unit 5 sets the control mode of the laser driver 30 in the first control mode (APC (1)). The image forming apparatus 1 of the present embodiment rotates the polygon mirror 15*a* using the BD signal 21 at target rotation speed. If the voltage of the light receiving signal output from the BD 20 does not exceed threshold, the BD signal 21 is not generated. Thereby, to generate the BD signal 21, the control unit 5 sets the control mode of the laser driver 30 in the first light amount control mode.

A description is provided, using FIG. 5A, with regard to the first light amount control mode executed by the laser driver 30 when starting up the optical scanning apparatus 2*a*. In the first light amount control mode, the control unit 5 outputs the voltage setting signal 31 with the duty ratio of 100%. Further, in the first light amount control mode, the control unit 5 outputs the sample hold signal 32 of Low level. The switch 36 is turned into a connected state by the sample hold signal 32 of Low level. Further, in the first light amount control mode, the control unit 5 outputs the video signal 42 of "High" level.

No charge is charged in the capacitor 38 immediately after the first light amount control mode is started in FIG. 5A so that no voltage difference is caused at both ends of the resistor 40. Thereby, immediately after the first control mode is started, no current flows in the LD 12*a*. Thereby, the PD 12*b* outputs no current $I_{pd}$ corresponding to the light amount of the laser light. The reference voltage Vref 34 generated by the reference setting signal 31 with the duty ratio of 100% is input into the APC circuit 35. The APC circuit 35 charges the capacitor 38 based on the comparison result between the reference voltage Vref 34 and the voltage $V_{pd}$ by the internal comparator. The voltage of the capacitor 38 increases by the charging by the APC circuit 35. By the Increase of the voltage of the capacitor 38, the voltage difference between both ends of the resistor 40 increases. When the voltage difference is caused at both ends of the resistor 40, the current $I_{LD}$ flows in the LD 12*a*. As shown in FIG. 5A, by the increase of the voltage of the capacitor 38 by the charging by the APC circuit 35, the light amount of the laser light (laser output) emitted from the LD 12*a* increases.

While the control mode is being set in the first light amount control mode, the voltage of the capacitor 38 gradually increases. In accordance with the increase of the voltage of the capacitor 38, the light amount of the laser light emitted from the LD 12*a* also increases. By the increase of the light amount of the laser light to some extent, the light receiving signal which is output from the BD 20 exceeds the threshold. Thereby, the BD signal 21 is generated. Thereafter, the laser driver 30 controls the voltage of the capacitor 38 until the reference voltage Vref 34 becomes equal to the voltage $V_{pd}$. When the BD 20 detects laser light L1 predetermined number of times and outputs the BD signal 21 predetermined number of times, the laser control mode turns to the second light amount control mode (APC(2)). The optical scanning apparatus 2*a* then performs light emission control in forming the image of one line (FIG. 5B).

When the BD signal 21 is generated in a target period, the control unit 5 starts the image formation. In the following, a description is provided, using FIG. 5B, with regard to the control mode set in the laser driver 30 during the image formation. FIG. 5B is a diagram illustrating a timing chart of one scanning period of the BD signal. During the image formation, the laser driver 30 repeatedly performs the control mode shown in FIG. 5B for every scanning period. As shown in FIG. 5B, in one scanning period, the control unit switches the control mode of the laser driver 30 to the first light amount control mode, the OFF mode, the second light amount control mode, the OFF mode, the VDO mode, the OFF mode, and the first light amount control mode in order.

As shown in FIG. 5B, to generate the BD signal 21, the control unit 5 sets the laser driver 30 in the first light amount control mode. The description with regard to the first light control mode is already provided as above. Based on the latest BD signal 21, the control unit 5 sets the laser driver 30 in the first light amount control mode immediately before the laser light next scans the BD 20. Before the laser light scans the BD 20, the light amount of the laser light reaches the light amount corresponding to the voltage setting signal 31 with the duty ratio of 100%. Thereby, the BD signal 21 is generated by the laser light of the light amount.

Then, as shown in FIG. 5B, the control unit 5 switches the laser driver 30 from the first light amount control mode to the OFF mode at timing based on the BD signal 21. In the OFF mode, the control unit 5 outputs the sample hold signal 32 of "High" level. By receiving the sample hold signal 32 of "High" level, the laser driver 30 releases the connection of the switch 36. Thereby, the voltage of the capacitor 38 is the voltage set in the first light amount control mode immediately before switching to the OFF mode. Then, as the switch 36 is released, the capacitor 38 is not charged/discharged by the APC circuit 35. Further, in the OFF mode, the control unit 5 outputs no video signal 42. Thereby, in the OFF mode, the transistor 41 turns OFF and no current $I_{LD}$ flows in the LD 12*a*. Further, in the OFF mode, the control unit 5 outputs the voltage setting signal 31 with the duty ratio below 100% to the laser driver 30. FIG. 5B shows a state in which the control unit 5 outputs the voltage setting signal 31 with the duty ratio of 25%.

As shown in FIG. 5B, the control unit 5 switches the laser driver 30 from the OFF mode to the second light amount control mode at timing based on the BD signal 21. In the second light amount control mode, the control unit 5 outputs the sample hold signal 32 of "Low" level. By receiving the sample hold signal 32 of "Low" level, the laser driver 30 connects the switch 36. Further, in the second light amount control mode, the control unit 5 outputs the video signal 42 of "High" level. Thereby, in the second light amount control mode, the transistor 41 turns ON. The current $I_{LD}$ flows in the LD 12*a*. The LD 12*a* emits the laser light of the laser amount corresponding to the current $I_{LD}$. Further, in the second light amount control mode, the same voltage setting signal 31 of the duty ratio as that output in the previous mode, i.e. the OFF mode immediately before switching to the second light amount control mode, is continuously output.

In the second light amount control mode, the laser light emitted from the LD 12*a* is incident on the PD 12*b*. The PD 12*b* outputs the current $I_{pd}$ corresponding to the light amount received. The voltage of one end of the resistor 37 is input into the APC circuit 35. Then, the reference voltage Vref 34 generated by the voltage setting signal 31 with the duty ratio of 25% is input into the APC circuit 35. The APC circuit discharges the capacitor 38 based on the comparison result between the reference voltage Vref 34 and the voltage $V_{pd}$ by the internal comparator.

As shown in FIG. 5B, the control unit 5 switches the laser driver 30 from the second light amount control mode to the OFF mode at timing based on the BD signal 21. The OFF mode is already described so that the description with regard to the OFF mode is omitted.

Then, as shown in FIG. 5B, the control unit 5 switches the laser driver 30 from the OFF mode to the VDO mode at timing based on the BD signal 21. In the VDO mode, continuing from the OFF mode immediately before the VDO mode, the control unit 5 outputs the sample hold signal 32 of "High" level. Thereby, the connection of the switch 36 of the laser driver 30 is released. As the connection of the switch 36 is released, the voltage of the capacitor 38 is the voltage set in the immediately before mode of the second light amount control mode. Then, as the switch 36 is released, the capacitor 38 is not charged/discharged by the APC circuit 35.

In the VDO mode, the control unit 5 outputs the video signal 42 (PWM signal) generated based on the image data. Thereby, in the VDO mode, ON/OFF of the transistor 41 is controlled based on the pulse of the video signal 42. When the transistor 41 turns ON, the current $I_{LD}$ flows in the LD 12*a*. The value of the current $I_{LD}$ flown in the LD 12*a* at this time is based on the voltage of the capacitor 38 set in the second light amount control mode. It means that, the current $I_{LD}$ flown in the LD 12*a* is defined by the voltage difference between both ends of the resistor 40 and the resistance value of the resistor 40. The voltage of one end of the resistor 40 is based on the voltage of the capacitor 38.

Then, as shown in FIG. 5B, the control unit 5 switches the laser driver 30 from the VDO mode to the OFF mode at timing based on the BD signal 21. The OFF mode is already described so that the description with regard to the OFF mode is omitted.

Then, as shown in FIG. 5B, the control unit 5 switches the laser driver 30 from the OFF mode to the first light amount control mode at timing based on the BD signal 21. As mentioned, in the first light amount control mode, the control unit 5 outputs the voltage setting signal 31 with the duty ratio of 100%. Further, in the first light amount control mode, the control unit 5 outputs the sample hold signal 32 of Low level. The switch 36 turns to the connected state by the sample hold signal 32 of Low level. Further, in the first light amount control mode, the control unit 5 outputs the video signal 42 of "High" level. The voltage of the capacitor 38 immediately before switching to the first light amount control mode is the voltage set in the second light amount control mode. In the first light amount control mode, the APC circuit 35 charges the capacitor 38 based on the comparison result between the voltage $V_{pd}$ and the reference voltage Vref 34 corresponding to the voltage setting signal with the duty ratio of 100%.

Here, a description with regard to the second light amount control mode is provided. The electrophotographic image forming apparatus 1 needs to control the laser light which exposes the photosensitive drum 25 in accordance with a state of the apparatus. It means that, due to aging deterioration of the photosensitive drum 25 and environmental state (temperature, humidity) of the image forming apparatus 1, sensitivity of the photosensitive drum 25 to the laser light changes. Further, the charged amount of the toner stored in the developing unit 512 changes depending on the environmental state. These changes cause a difference between a density of the image output by the image forming apparatus 1 and a density of the image user desires. To solve the problem, the electrophotographic image forming apparatus 1 controls the light amount of the LD 12 in accordance with satisfaction that predetermined condition, such as forming images on a predetermined number of sheets, is satisfied immediately after a source of the apparatus is turned ON. For example, the image forming apparatus 1 forms density detection pattern for each color formed on the intermediate transfer belt 511. Then, based on the detection result, the image forming apparatus 1 controls the light amount of the LD 12*a* corresponding to each color.

In this manner, by performing switching, by the control unit 5, of the control mode as mentioned in one scanning period, it is possible to separately control the light amount of the laser light made incident on the BD 20 and the light amount of the laser light which scans the photosensitive drum 25. Due to this, it is possible to control the light amount of the laser light made incident on the BD 20 and the light amount of the laser light which exposes the photosensitive drum 25 with high accuracy. The light amount of the laser light which is incident on the BD 20 is controlled substantially constant regardless of the light amount of the laser light which exposes the photosensitive drum 25. Thereby, regardless of the light amount of the laser light which exposes the photosensitive drum 25, it is possible to define a writing start position of the image in a main scanning direction substantially constant. The light amount of the laser light which exposes the photosensitive drum 25 is smaller than that of the laser light made incident on the BD 20. Thereby, the reference voltage Vref 34 when emitting the laser light made incident on the BD 20 is a value higher than the reference value Vref 34 when emitting the laser light which exposes the photosensitive drum 25.

It is noted that the duty ratio of the voltage setting signal 31 for generating the BD signal 21 is not necessarily be 100%. For example, it is desired that the duty ratio of the voltage setting signal 31 for generating the BD signal 21 be separately adjusted when assembling the apparatus by the gain of the photoelectric conversion elements of the BD 20 etc.

(Embodiment 2)

Figure 6:
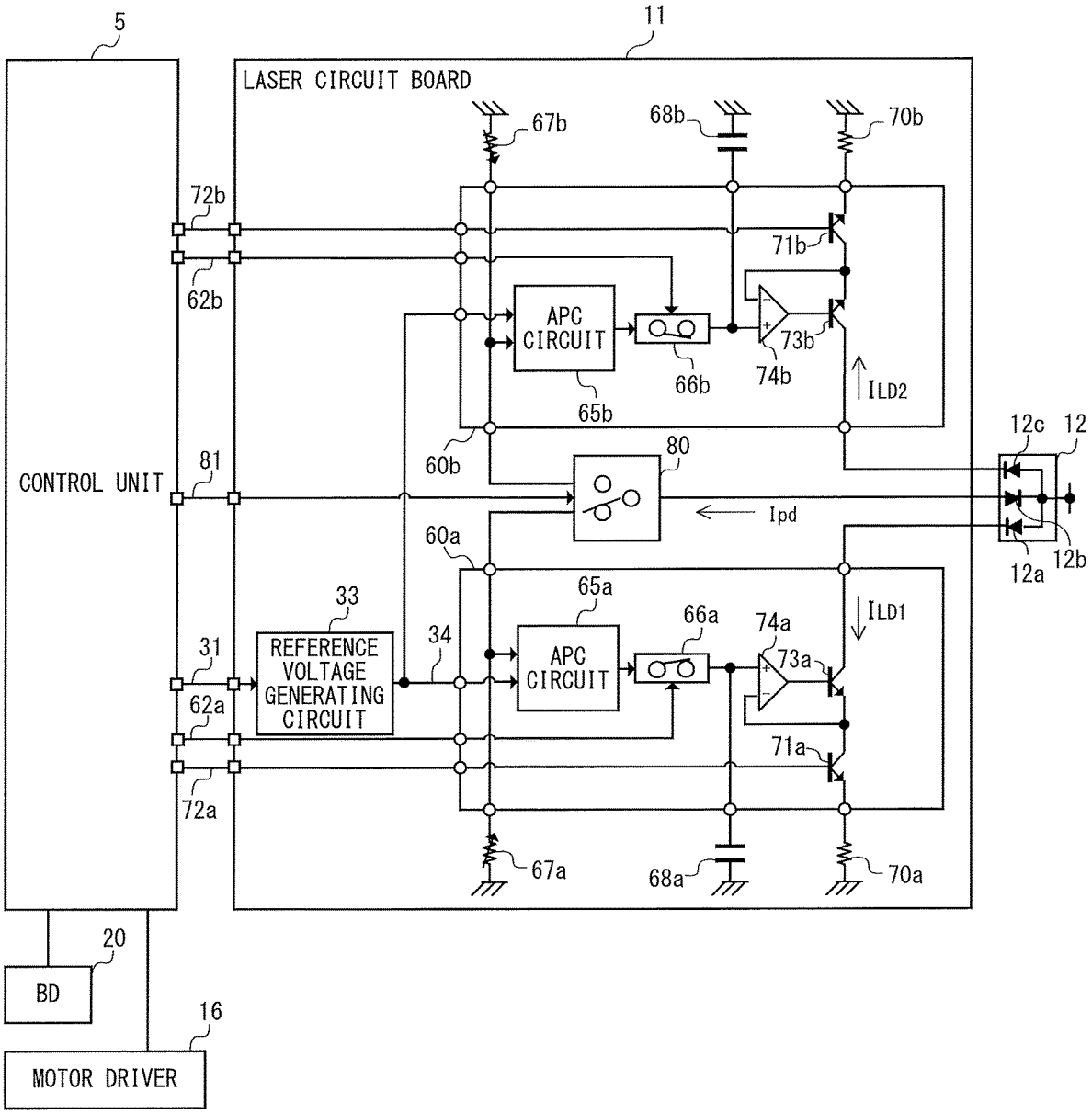
FIG. 6 is a configuration diagram of the laser circuit board according to the Embodiment 1.

FIG. 6 is another configuration diagram of the laser circuit board 11. The laser circuit board 11 of the Embodiment 2 performs light emission control of a plurality of light emitting elements LD 12*a* and LD 12*c* which respectively emit light. The laser circuit board 11 comprises a plurality of laser drivers 60*a* and 60*b* having the same configuration as that of the laser driver 30 shown in FIG. 3. The laser driver 60*a* and the laser driver 60*b* may be one IC or they may be different ICs. Each configuration of the laser drivers 60*a* and 60*b* is the same as that of the laser driver 30 as described in the Embodiment 1 so that the description thereof is omitted. The control unit 5 inputs the sample hold signals 62*a* and 62*b* and video signals 72*a* and 72*b* into the respective laser drivers 60*a* and 60*b*.

In addition to two laser drivers 60*a* and 60*b*, the laser circuit board 11 comprises the reference voltage generating circuit 33 and a PD switch 80. The reference voltage generating circuit 33 has the same configuration and functions as that shown in FIG. 3 and generates the reference voltage Vref 34 in response to the voltage setting signal 31 which is input from the control unit 5. In response to a PD switching signal 81 which is input from the control unit 5, the PD switch 80 inputs the current $I_{pd}$ which is output from the PD 12*b* into one of the laser driver 60*a* or the laser driver 60*b*. Further, the reference voltage generating circuit 33 may be disposed inside the laser driver 60*a* and 60*b*, or inside the control unit 5.

Figure 7A:
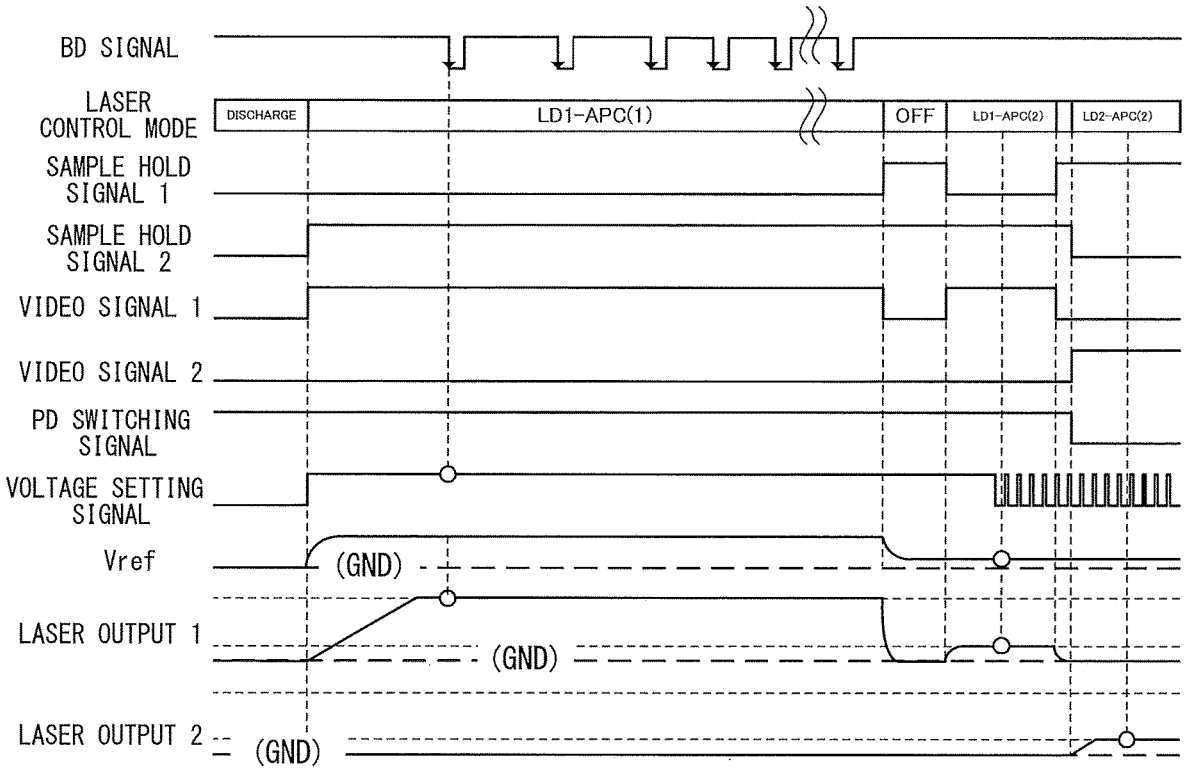
FIGS. 7A and 7B are timing charts of light emission control of semiconductor laser by a laser circuit board according to an Embodiment 2.
Figure 7B:
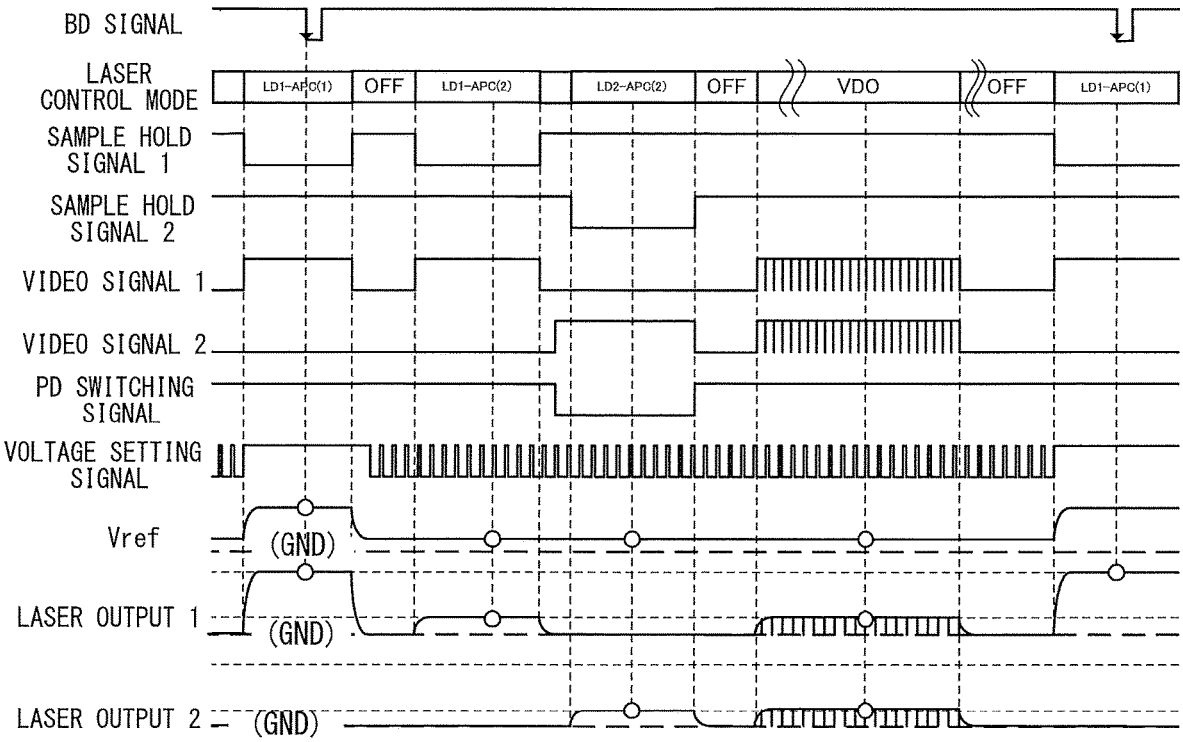
Figure 8:
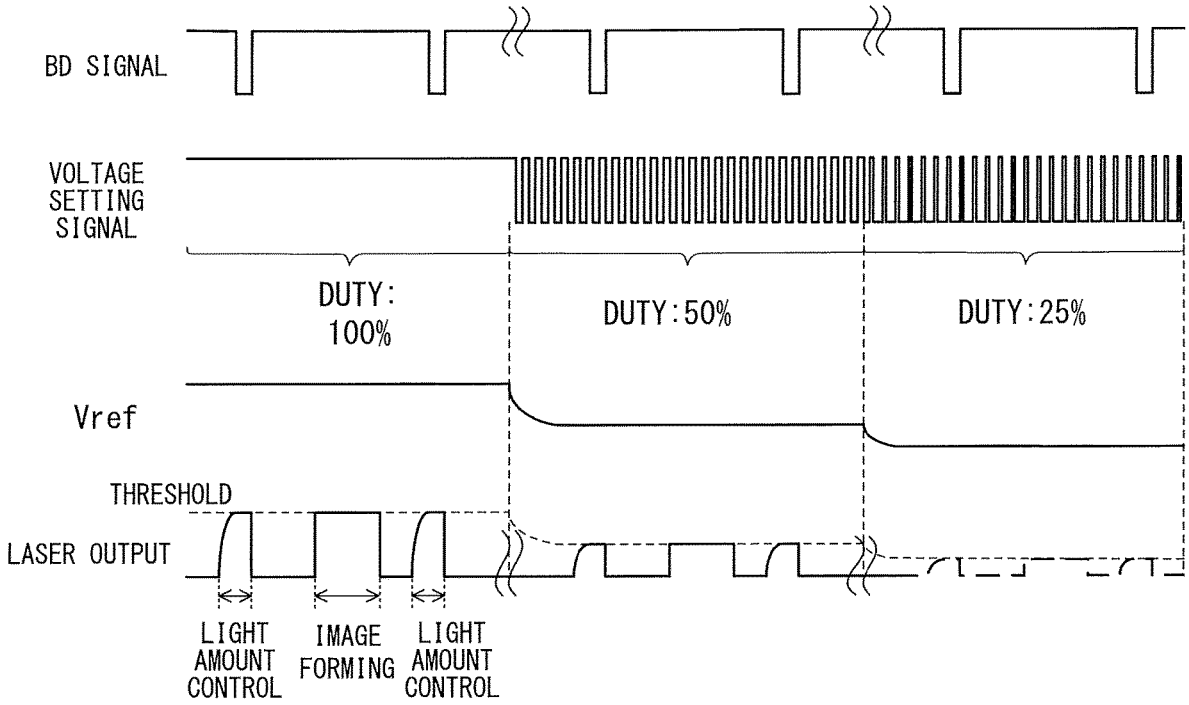
FIG. 8 is a timing chart of light emission control of the conventional semiconductor laser.

FIGS. 7A and 7B are timing charts showing a control state of the laser circuit board 11 shown in FIG. 6. FIG. 7A represents a timing chart when starting up the optical scanning apparatus 2*a*. FIG. 7B represents a timing chart of one scanning period of the laser light during the image formation of one line. Following FIG. 7A, processing in accordance with the timing chart of FIG. 7B is executed. In response to the sample hold signals 62*a* and 62*b* and the video signals 72*a* and 72*b* which are input from the control unit 5, the laser circuit board 11 performs light emission control of the semiconductor laser 12 with the falling of the BD signal as a starting point. The image forming apparatus 1 of the present embodiment generates the BD signal 21 by making the laser light L1 emitted from the LD 12*a* incident on the BD 20. The laser light L2 emitted from the LD 12*c* does not contribute to the generation of the BD signal 21. FIGS. 7A and 7B are timing charts based on the BD signal 21 which is output by receiving, by the BD 20, the laser light L1 output from the LD 12*a*. The control state of the laser drivers 60*a* and 60*b* is determined with the falling of the BD signal 21 as a start point.

Before starting up the optical scanning apparatus 2*a*, the control unit 5 sets the control mode of the laser drivers 60*a* and 60*b* in the stop (DISCHARGE) mode. In the DISCHARGE mode, no charge is accumulated in a hold capacitor 68 (a first capacitor) and a hold capacitor 68*b* (a second capacitor).

By the input of the image data into the image forming apparatus 1, the control unit 5 transmits the acceleration signal to the motor driver 16 to start the rotation of the polygon mirror 15*a* of the optical scanning apparatus 2*a*. When starting up the optical scanning apparatus 2*a*, the control unit 5 sets the control mode of the laser driver 60*a* in the first light amount control mode (LD1-APC (1)). While the first light amount control mode is being executed, the laser driver 60*b* turns to the OFF mode. Further, the OFF mode shown in FIG. 7B shows that both the laser drivers 60*a* and 60*b* turn to the OFF mode. In the OFF mode, the control unit 5 outputs the video signals 72*a* and 72*b*, which are the PWM signals of Low level. Due to this, the transistors 71*a* and 71*b* turn to the OFF state. Thereby, no current $I_{LD1}$ flows in the LD 12*a*. Also, no current $I_{LD2}$ flows in the LD 12*c*.

In the first light amount control mode (LD1-APC(1)), the control unit 5 sets the video signal 72*a* to the High level and sets the video signal 72*b* to the Low level. Due to this, the transistor 71*a* turns to the ON state and the transistor 71*b* turns to the OFF state. Further, in the first light amount control mode, the control unit 5 outputs the voltage setting signal 31 with the duty ratio of 100%. Further, in the first light amount control mode, the control unit 5 outputs the PD switching signal 81 of High level to connect the PD 12*b* with the resistor 67*a*. Also, by outputting the sample hold signal 62*b* of Low level, the control unit 5 connects a switch 66*a* (sample state). At this time, the sample hold signal 62*b* is in the High level and a switch 66*b* is in a non-connected state (hold state).

In the first light amount control mode, the laser driver 60*a* gradually charges the capacitor 68*a* to decrease the difference between the value of the reference voltage Vref 34 in which the voltage setting signal 31 with the duty ratio of 100% is smoothed and a terminal voltage $V_{pd1}$ of a side to which the resistor 67*a* is not grounded. In accordance with the increase of the voltage of the capacitor 68*a*, the light amount of the laser light L1 emitted from the LD 12*a* increases. By the increase of the light amount of the laser light L1 emitted from the LD 12*a* to some extent, the light receiving signal which is output from the BD 20 exceeds the threshold. Thereby, the BD signal 21 is generated. Thereafter, the laser driver 60*a* controls the voltage of the capacitor 68*a* until the reference voltage Vref 34 becomes equal to the terminal voltage $V_{pd1}$. When the BD 20 detects laser the light L1 predetermined number of times and outputs the BD signal 21 predetermined number of times, the laser control mode turns to the second light amount control mode (LD1-APC(2)). The optical scanning apparatus 2*a* performs the light emission control in forming the image of one line (FIG. 7B).

When the BD signal 21 is generated in a target period, the control unit 5 starts the image formation. In the following, a description is provided, using FIG. 7B, with regard to the control mode set in the laser driver 60*a* during the image formation. After the first light amount control mode shown in FIG. 7A, the control unit 5 switches the laser driver 60*a* from the first light amount control mode to the OFF mode at a timing based on the BD signal 21 (see FIG. 7B). Thereafter, the control unit 5 switches the control mode of the laser driver 60*a* from the OFF mode to the second light amount control mode (LD1-APC (2)) at a timing based on the BD signal 21. While the second light amount control mode is being set, the laser driver 60*b* turns to the OFF mode.

In the second light amount control mode (LD1-APC (2)), the control unit 5 sets the video signal 72*a* to the High level and sets the video signal 72*b* to the Low level. Due to this, the transistor 71*a* turns to the ON state and the transistor 71*b* turns to the OFF state. Further, in the second light amount control mode, the control unit 5 outputs the voltage setting signal 31 with the duty ratio of 25% to the laser circuit board 11. Due to this, the value of the reference voltage Vref 34 is accordingly reduced by ¼ as compared to that when the duty ratio of the voltage setting signal 31 is 100%. The light amount of the laser light emitted from the semiconductor laser 12 is accordingly reduced by ¼ as compared to that when the duty ratio of the voltage setting signal 31 is 100%.

Further, in the second light amount control mode, the control unit 5 outputs the PD switching signal 81 of High level to connect the PD 12*b* with the resistor 67*a*. Also, by outputting the sample hold signal 62*a* of Low level, the control unit 5 connects the switch 66*a* (sample state). At this time, the sample hold signal 62*b* is in the High level and the switch 66*b* is in the non-connected state (hold state).

In the second light amount control mode, the laser driver 60*a* compares the reference voltage Vref 34 in which the voltage setting signal 31 with the duty ratio of 25% is smoothed with the terminal voltage $V_{pd1}$ of a side to which the resistor 67*a* is not grounded. Then, the laser driver 60*a* controls the voltage of the capacitor 68*a* such that the reference voltage Vref 34 becomes equal to the terminal voltage $V_{pd1}$. The current $I_{LD1}$ based on the voltage which is controlled here is supplied to the LD 12*a* during scanning the photosensitive drum 25.

Thereafter, the control unit 5 switches the laser driver 60*a* from the second light amount control mode to the OFF mode at timing based on the BD signal 21 (see FIG. 7B). Then, the control unit 5 switches the laser driver 60*b* from the OFF mode to a third light amount control mode (LD2-APC (2)).

In the third light amount control mode (LD2-APC (2)), the control unit 5 sets the video signal 72*a* to the Low level and sets the video signal 72*b* to the High level. Due to this, the transistor 71*a* turns to the OFF state and the transistor 71*b* turns to the ON state. Further, in the third light amount control mode, the control unit 5 outputs the voltage setting signal 31 with the duty ratio of 25% to the laser circuit board 11. Due to this, the value of the reference voltage Vref 34 is accordingly reduced by ¼ as compared to that when the duty ratio of the voltage setting signal 31 is 100%. The light amount of the laser light emitted from the semiconductor laser 12 is accordingly reduced by ¼ as compared to that when the duty ratio of the voltage setting signal 31 is 100%.

In the third light amount control mode, the control unit 5 outputs the PD switching signal 81 of Low level to connect the PD 12*b* with the resistor 67*b*. Also, by outputting the sample hold signal 62*b* of High level, the control unit 5 connects the switch 66*b* (sample state). At this time, the sample hold signal 62*a* is in the Low level and a switch 66*a* is in the non-connected state (hold state).

In the third light amount control mode, the laser driver 60*a* compares the reference voltage Vref 34 in which the voltage setting signal 31 with the duty ratio of 25% is smoothed with a terminal voltage $V_{pd2}$ of a side to which the resistor 67*a* is not grounded. Then, the laser driver 60*a* controls the voltage of the capacitor 68*b* such that the reference voltage Vref 34 becomes equal to the terminal voltage $V_{pd2}$. The current $I_{LD2}$ based on the voltage which is controlled here is supplied to the LD 12*c* during scanning the photosensitive drum 25.

As shown in FIG. 7B, the image forming apparatus 1 of the present embodiment separately performs the first light amount control mode, the second light amount control mode, and the third light amount control mode one time during one scanning period of the laser light. Through the first light amount control mode, the image forming apparatus 1 controls the laser light L1 to the first target light amount. Through the second light amount control mode, the image forming apparatus 1 controls the laser light L2 to second first target light amount. Through the third light amount control mode, the image forming apparatus 1 controls the laser light L2 to the second target light amount.

In this manner, by performing switching, by the control unit 5, of the control mode as mentioned in one scanning period, it is possible to separately control the light amount of the laser light L1 made incident on the BD 20 and the light amount of the laser light L1 and the laser light L2 which scan the photosensitive drum 25. Due to this, it is possible to control the light amount of the laser light L1 made incident on the BD 20 and the light amount of the laser light L1 and the laser light L2 which expose the photosensitive drum 25 with high accuracy. The light amount of the laser light L1 which is incident on the BD is controlled substantially constant regardless of the light amount of the laser light L1 and the laser light L2 which exposes the photosensitive drum 25. Thereby, regardless of the light amount of the laser light L1 and the laser light L2 which exposes the photosensitive drum 25, it is possible to define a writing start position of the image in a main scanning direction substantially constant.

With the image forming apparatus as mentioned, it is possible to control the light amount of the laser light made incident on the BD 20 which receives the laser light for generating the BD signal 21 and the light amount of the laser light which exposes the photosensitive drum 25 with high accuracy.

(Embodiment 3)

Figure 9:
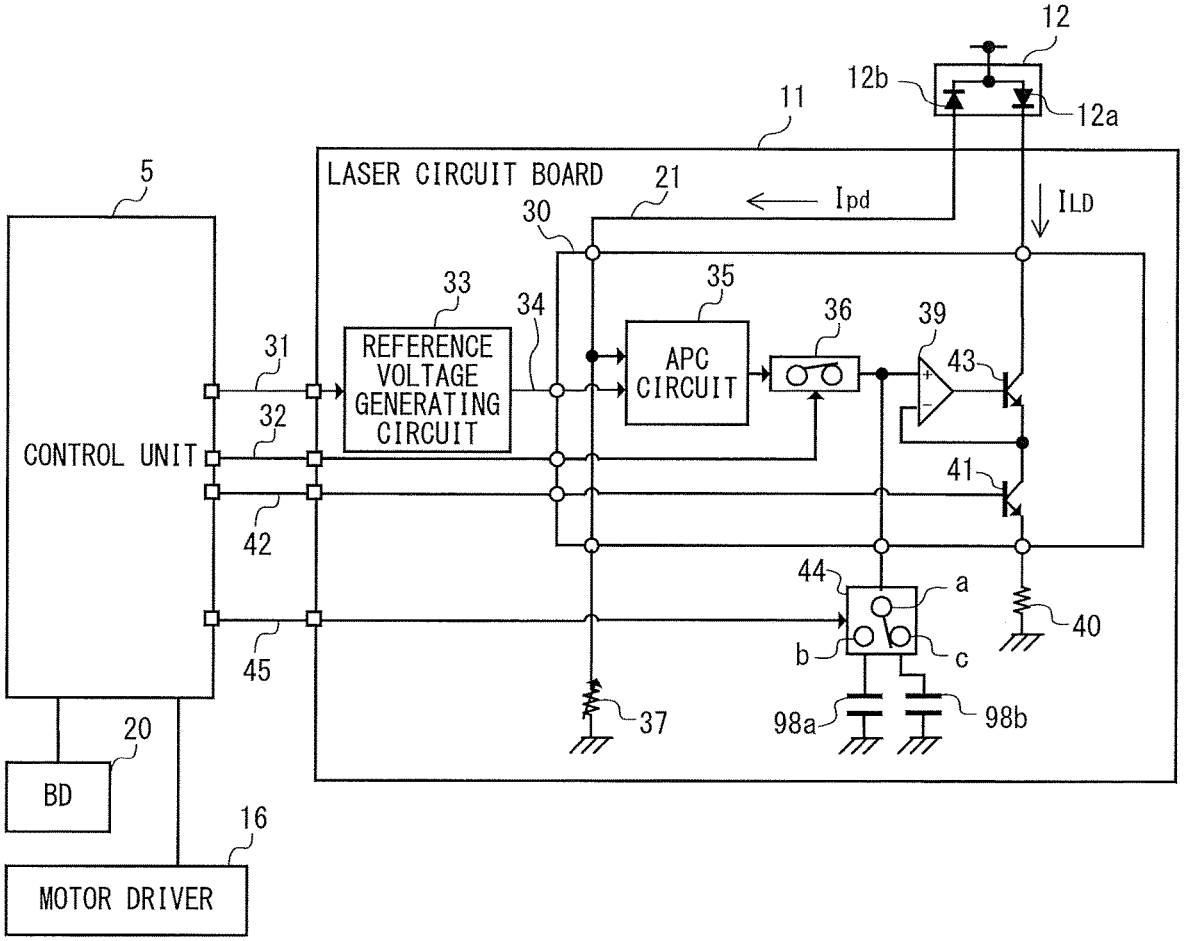
FIG. 9 is a configuration diagram of a laser circuit board according to an Embodiment 3.

FIG. 9 is a control block diagram for driving the semiconductor laser 12. The laser circuit board 11 of the Embodiment 3 has almost the same configuration as that of the laser circuit board 11 of the Embodiment 1 shown in FIG. 3. Instead of the capacitor 38, the laser circuit board 11 of the present embodiment comprises a capacitor 98*a* (a first capacitor/a first holding unit), a capacitor 98*b* (a second capacitor/a second holding unit), and a switch 44. The laser circuit board 11 is connected to the control unit 5 by a cable. The difference with the laser circuit board shown in FIG. 3 is described.

The capacitor 98*a* is provided to emit the laser light made incident on the BD 20 from the LD 12*a*. The capacitor 98*b* is provided to emit the laser light which scans the photosensitive drum 25 from the LD 12*a*.

Figure 10:
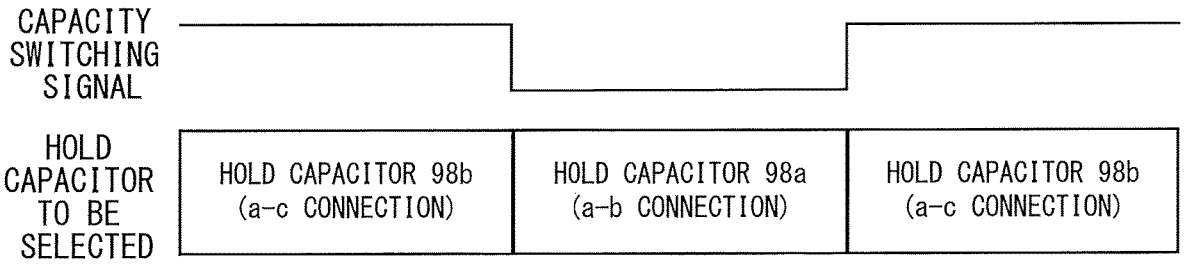
FIG. 10 is a timing chart showing a hold capacitor selection method.

The switch 44 operates in response to a capacity switching signal 45 as shown in FIG. 10. The capacity switching signal 45 is input from the control unit 5. When the capacity switching signal 45 is Low, the switch 44 connects a terminal a with a terminal b. When the terminal a and the terminal b are connected, a voltage Vch_a of the capacitor 98*a* is applied to the non-inverting terminal of the comparator 39. On the other hand, if the capacity switching signal 45 is High, the switch 44 connects the terminal a with a terminal c. When the terminal a and the terminal c are connected, a voltage Vch_b of the capacitor 98*b* is applied to the non-inverting terminal of the comparator 39. The inverting terminal of the comparator 39 is connected to an emitter terminal of the transistor 43 and the anode terminal of the resistor 40. Thereby, voltage V− of the inverting terminal of the comparator 39 becomes equal to the voltage of the anode terminal of the resistor 40.

The value of the current $I_{LD}$ is defined by the voltage of the capacitor 98*a* or the capacitor 98*b* connected to the non-inverting terminal of the comparator 39 and the resistance value of the resistor 40. An anode terminal of the resistor 40 is connected to an emitter terminal of the transistor 41. The cathode terminal of the resistor 40 is grounded. A collector terminal of the transistor 41 is connected to an emitter terminal of the transistor 43. A base terminal of the transistor 43 is connected to an output terminal of the comparator 39.

The voltage V− of the inverting terminal of the comparator 39 is defined by the value of the current $I_{LD}$ and the resistor 40. Based on the comparison result between the voltage V+ of the non-inverting terminal and the voltage V− of the inverting terminal, the comparator 39 controls the base voltage of the transistor 43. It means that the base voltage of the transistor 43 is controlled so that it becomes the voltage corresponding to the voltage of the capacitor 98*a* or the capacitor 98*b*. The base voltage of the transistor 43 is controlled in this manner so that the voltage of the anode terminal of the resistor 40 is controlled. As a result, the value of the current $I_{LD}$ is controlled.

The APC in the present embodiment is executed to control the voltage of the capacitor 98*a* or the capacitor 98*b* to the voltage corresponding to the target light amount of the laser light.

Figure 11A:
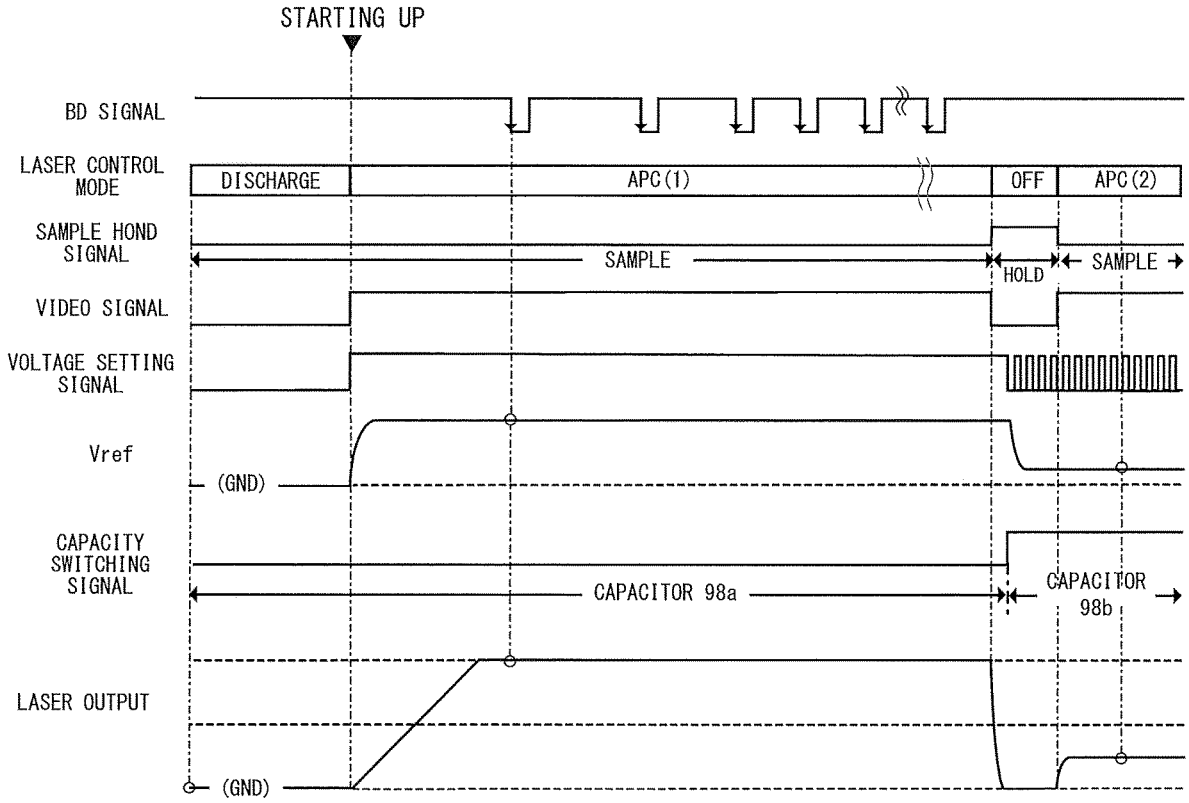
FIGS. 11A and 11B are timing charts of light emission control of semiconductor laser by the laser circuit board according to the Embodiment 3.
Figure 11B:
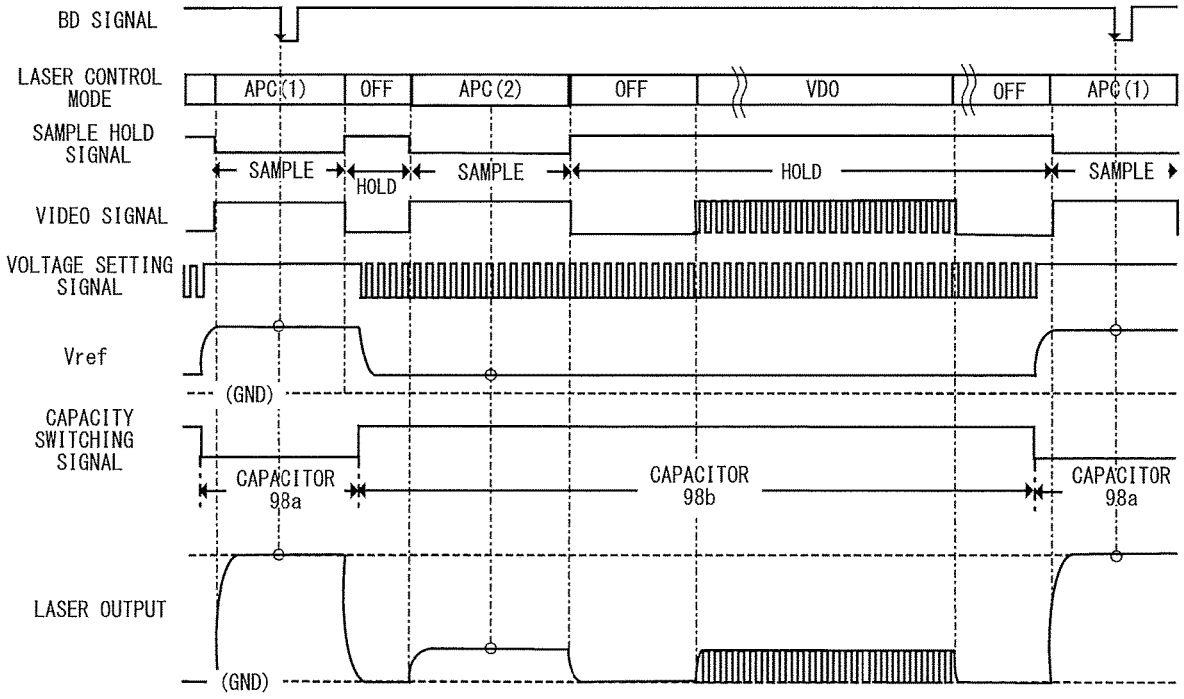

FIGS. 11A and 11B are timing charts showing a control state of the laser circuit board 11. FIG. 11A represents a timing chart when starting up the optical scanning apparatus 2*a*. FIG. 11B represents a timing chart of one scanning period of the laser light during the image formation. Following FIG. 11A, processing in accordance with the timing chart of FIG. 11B is executed. The control state of the laser driver 30 is switched by the control unit 5 with the falling of the BD signal 21 as a starting point.

Before starting up the optical scanning apparatus 2*a*, the control unit 5 sets the control mode of the laser driver 30 in the stop (DISCHARGE) mode. In the DISCHARGE mode, no charge is accumulated in the capacitor 98*a* and the capacitor 98*b*. By the input of the image data into the image forming apparatus 1, the control unit 5 transmits the acceleration signal to the motor driver 16 to start the rotation of the polygon mirror 15*a* of the optical scanning apparatus 2*a*. When starting up the optical scanning apparatus 2*a*, the control unit 5 sets the control mode of the laser driver 30 in the first control mode (APC (1)). The image forming apparatus 1 of the present embodiment rotates the polygon mirror 15*a* using the BD signal 21 at the target rotation speed. If the voltage of the light receiving signal output from the BD 20 does not exceed the threshold, the BD signal 21 is not generated. Thereby, to generate the BD signal 21, the control unit 5 sets the control mode of the laser driver 30 in the first light amount control mode.

A description is provided, using FIG. 11A, with regard to the first light amount control mode executed by the laser driver 30 when starting up the optical scanning apparatus 2*a*. First, the control unit 5 needs to generate the BD signal to stabilize the rotation speed of the polygon mirror 15*a*. Thereby, the control unit 5 controls a laser driving circuit to the first light amount control mode so that the optical scanning apparatus 2*a* can generate the BD signal.

In the first light amount control mode, the control unit 5 outputs the voltage setting signal 31 with the duty ratio of 100%. Further, in the first light amount control mode, the control unit 5 outputs the sample hold signal 32 of Low level. The switch 36 turns to the connected state by the sample hold signal 32 of Low level. Further, in the first light amount control mode, the control unit 5 outputs the video signal 42 of High level. Further, in the first light amount control mode, the control unit 5 outputs the capacity switching signal 45 of Low level. With the capacity switching signal 45 of Low level, the switch 44 connects the terminal a with the terminal b.

No charge is charged in the capacitor 98*a* immediately after the first light amount control mode is started in FIG. 11A so that no voltage difference is caused at both ends of the resistor 40. Thereby, immediately after the start of the first control mode, no current flows in the LD 12*a*. Thereby, the PD 12*b* outputs no current $I_{pd}$ corresponding to the light amount of the laser light.

The reference voltage Vref 34 generated by the reference setting signal 31 with the duty ratio of 100% is input into the APC circuit 35. The APC circuit 35 charges the capacitor 98*a* based on the comparison result between the reference voltage Vref 34 and the voltage $V_{pd}$ by the internal comparator. The voltage Vch_a of the capacitor 98*a* increases by the charging by the APC circuit 35. By the Increase of the voltage Vch_a of the capacitor 98*a*, the voltage difference between both ends of the resistor 40 increases. When the voltage difference is caused at both ends of the resistor 40, the current $I_{LD}$ flows in the LD 12*a*. As shown in FIG. 6A, with the increase of the voltage Vch_a of the capacitor 98*a* by the charging by the APC circuit 35, the light amount of the laser light (laser output) emitted from the LD 12 increases.

While the control mode is being set in the first light amount control mode, the voltage Vch_a of the capacitor 98 gradually increases. In accordance with the increase of the voltage Vch_a of the capacitor 98*a*, the light amount of the laser light emitted from the LD 12*a* increases. By the increase of the light amount of the laser light to some extent, the light receiving signal output from the BD 20 exceeds the threshold. Thereby, the BD signal 21 is generated. Thereafter, the laser driver 30 controls the voltage Vch_a of the capacitor 98*a* until the reference voltage Vref 34 becomes equal to the voltage $V_{pd}$. When the BD 20 detects the laser light L1 predetermined number of times and outputs the BD signal 21 predetermined number of times, the laser control mode turns to the second light amount control mode (APC (2)). The optical scanning apparatus 2*a* performs light emission control in forming the image of one line (FIG. 11B).

When the BD signal 21 is generated in a target period, the control unit 5 starts the image formation. In the following, a description is provided, using FIG. 11B, with regard to the control mode set in the laser driver 30 during the image formation. FIG. 11B represents a timing chart of one scanning period of the BD signal. During the image formation, the laser driver 30 repeatedly performs the control mode shown in FIG. 11B for every scanning period.

As shown in FIG. 11B, in one scanning period, the control unit 5 switches the control mode of the laser driver 30 to the first light amount control mode, the OFF mode, the second light amount control mode, the OFF mode, the VDO mode, the OFF mode, and the first light amount control mode in order.

To generate the BD signal 21, the control unit 5 sets the laser driver 30 in the first light amount control mode. The description with regard to the first light control mode is already provided as above. Based on the latest BD signal 21, the control unit 5 sets the laser driver 30 in the first light amount control mode immediately before the laser light next scans the BD 20. Before scanning the BD 20 with the laser light, the light amount of the laser light reaches the light amount corresponding to the voltage setting signal 31 with the duty ratio of 100%. Thereby, the BD signal 21 is generated by the laser light of the light amount.

Then, as shown in FIG. 11B, the control unit 5 switches the laser driver 30 from the first light amount control mode to the OFF mode at timing based on the BD signal 21. In the OFF mode, the control unit 5 outputs the sample hold signal 32 of High level. By receiving the sample hold signal 32 of High level, the laser driver 30 releases the connection of the switch 36. Thereby, the voltage Vch_a of the capacitor 98*a* is the voltage set in the first light amount control mode immediately before switching to the OFF mode. Then, as the switch 36 is released, the capacitor 98*a* is not charged/discharged by the APC circuit 35.

Further, in the OFF mode, the control unit 5 outputs no video signal 42. Thereby, in the OFF mode, the transistor 41 turns OFF and no current $I_{LD}$ flows in the LD 12*a*. Further, in the OFF mode, the control unit 5 outputs the voltage setting signal 31 with the duty ratio below 100% to the laser driver 30. FIG. 11B shows a state in which the control unit 5 outputs the voltage setting signal 31 with the duty ratio of 25%.

Further, the control unit 5 switches the capacity switching signal 45 from Low to High during the OFF mode. With the capacity switching signal 45 of High level, the switch 44 connects the terminal a with the terminal c.

As shown in FIG. 11B, the control unit 5 switches the laser driver 30 from the OFF mode to the second light amount control mode at timing based on the BD signal 21. In the second light amount control mode, the control unit 5 outputs the sample hold signal 32 of Low level. By receiving the sample hold signal 32 of Low level, the laser driver 30 connects the switch 36. Further, in the second light amount control mode, the control unit 5 outputs the video signal 42 of High level. Thereby, in the second light amount control mode, the transistor 41 turns ON. The current $I_{LD}$ flows in the LD 12*a*. The LD 12*a* emits the laser light of the laser amount corresponding to the current $I_{LD}$. Further, in the second light amount control mode, the same voltage setting signal 31 of the duty ratio as that output in the previous mode, i.e. the OFF mode immediately before switching to the second light amount control mode, is continuously output.

In the second light amount control mode, the laser light emitted from the LD 12*a* is made incident on the PD 12*b*. The PD 12*b* outputs the current $I_{pd}$ corresponding to the light amount received. The voltage of one end of the resistor 37 is input into the APC circuit 35. Then, the reference voltage Vref 34 generated by the voltage setting signal 31 with the duty ratio of 25% is input into the APC circuit 35. Based on the comparison result between the reference voltage Vref 34 and the voltage $V_{pd}$ by the internal comparator, the APC circuit 35 controls the voltage Vch_b of the capacitor 98*b*.

As shown in FIG. 11B, the control unit 5 switches the laser driver 30 from the second light amount control mode to the OFF mode at timing based on the BD signal 21. In the OFF mode between the second light amount control mode and the VDO mode, the control unit 5 continuously outputs the capacity switching signal 45 of High level.

Then, as shown in FIG. 11B, the control unit 5 switches the laser driver 30 from the OFF mode to the VDO mode at timing based on the BD signal 21. In the VDO mode, continuing from the OFF mode immediately before the VDO mode, the control unit 5 outputs the sample hold signal 32 of High level and the capacity switching signal 45 of High level. Thereby, the connection of the switch 36 of the laser driver 30 is released. As the connection of the switch 36 is released, the voltage Vch_b of the capacitor 98*b* is maintained at the voltage set in the immediately before mode of the second light amount control mode. Then, as the switch 36 is released, the capacitor 98*b* is not charged/discharged by the APC circuit 35. Further, as the terminal a and the terminal c are connected by the capacity switching signal 45, the voltage of the capacitor 98*b* is input to the non-inverting terminal of the comparator 39.

In the VDO mode, the control unit 5 outputs the video signal (PWM signal) generated based on the image data. Thereby, in the VDO mode, ON/OFF of the transistor 41 is controlled based on the pulse of the VDO signal. When the transistor 41 turns ON, the current $I_{LD}$ flows in the LD 12*a*. The value of the current $I_{LD}$ flown in the LD 12*a* at this time is based on the voltage Vch_b of the capacitor 98*b* set in the second light amount control mode. It means that, the current $I_{LD}$ flown in the LD 12*a* is defined by the voltage difference between both ends of the resistor 40 and the resistance value of the resistor 40. The voltage of one end of the resistor 40 is based on the voltage Vch_b of the capacitor 98*b*.

Then, as shown in FIG. 11B, the control unit 5 switches the laser driver 30 from the VDO mode to the OFF mode at timing based on the BD signal 21. In the OFF mode at this time, the control unit 5 switches the capacity switching signal 45 from the High level to the Low level. Through this, the switch 44 connects the terminal a with the terminal b.

Then, as shown in FIG. 11B, the control unit 5 switches the laser driver 30 from the OFF mode to the first light amount control mode at timing based on the BD signal 21. As mentioned, in the first light amount control mode, the control unit 5 outputs the voltage setting signal 31 with the duty ratio of 100%. Further, in the first light amount control mode, the control unit 5 outputs the sample hold signal 32 of Low level. The switch 36 turns to the connected state by the sample hold signal 32 of Low level. Further, in the first light amount control mode, the control unit 5 outputs the video signal of High level. The voltage Vch_a of the capacitor 98*a* immediately before switching to the first light amount control mode is the voltage set by the previous first light amount control mode. In the first light amount control mode, the APC circuit 35 controls the voltage Vch_a of the capacitor 98*a* based on the comparison result between the voltage $V_{pd}$ and the reference voltage Vref 34 corresponding to the voltage setting signal with the duty ratio of 100%.

Here, a description with regard to the second light amount control mode is provided. The electrophotographic image forming apparatus 1 needs to control the laser light which exposes the photosensitive drum 25 in accordance with a state of the image forming apparatus 1. It means that, due to aging deterioration of the photosensitive drum 25 and environmental state (temperature, humidity) of the image forming apparatus 1, sensitivity of the photosensitive drum 25 to the laser light changes. Further, the charged amount of the toner stored in the developing unit 512 changes depending on the environmental state. These changes cause difference between the density of the image output by the image forming apparatus 1 and the density of the image a user desires. To solve the problem, the electrophotographic image forming apparatus 1 controls the light amount of the LD 12*a* in accordance with satisfaction that predetermined condition, such as forming images on predetermined number of sheets, is satisfied immediately after the power of the apparatus is turned ON. For example, the image forming apparatus 1 forms density detection pattern for each color formed on the intermediate transfer body 511. Then, based on the detection result, the image forming apparatus 1 controls the light amount of the LD 12*a* corresponding to each color.

In this manner, by performing switching, by the control unit 5, the control mode as mentioned in one scanning period, it is possible to separately control the light amount of the laser light made incident on the BD 20 and the light amount of the laser light which scans the photosensitive drum 25. Due to this, it is possible to control the light amount of the laser light made incident on the BD 20 and the light amount of the laser light which exposes the photosensitive drum 25 with high accuracy. The light amount of the laser light which is incident on the BD is controlled substantially constant regardless of the light amount of the laser light which exposes the photosensitive drum 25. Thereby, regardless of the light amount of the laser light which exposes the photosensitive drum 25, it is possible to define a writing start position of the image in a main scanning direction substantially constant. The light amount of the laser light which exposes the photosensitive drum is smaller than that of the laser light made incident on the BD 20. Thereby, the value of the reference voltage Vref when emitting the laser light made incident on the BD 20 is higher than that of the reference voltage Vref when emitting the laser light which exposes the photosensitive drum 25.

It is noted that the duty ratio of the voltage setting signal 31 for generating the BD signal 21 is not necessarily be 100%. For example, it is desired that the duty ratio of the voltage setting signal 31 for generating the BD signal 21 be separately adjusted when assembling the apparatus by gain of the photoelectric conversion elements of the BD 20 etc.

In the following, a specification example of the semiconductor laser 12 and an example of the control target value are shown.

(Specification)

A light emission initiation current Ith of the semiconductor laser 12 is 5 ma and light emission efficiency η of the semiconductor laser 12 is 0.5 mW/ma.

A charging/discharging current Id of the laser driver is 1 μA, a leak current I_leak of a terminal to which the switch 44 is connected is 0.1 μA, a current amplification factor α is 100 times, the resistor 40 is 10 kΩ.

Scanning time of the optical scanning apparatus 2*a* is as follows. Time T1 for a first light emission control mode is 25 μS. Time T2 for an image forming mode is 500 μS.

(Control Target Value)

Following shows the control target value in each laser control mode where light amount Po is 5 mW (Light amount Po=5 mW).

At the first light amount control mode, rising time of light amount waveform Tr is below 5 μS (first target value).

At the image forming mode, a light amount variation rate ΔPo is below 0.5% (second target value).

Capacity of the capacitor 98*a* needs to be converged to the time T1 for the first light amount control mode with respect to variation amount of an inter-terminal voltage of the capacitor 98*a* ΔVch_a generated during scanning in the first light amount control mode. Thereby, the first target value needs to be satisfied. Variation amount ΔILD of a driving current with respect to the light amount variation rate ΔPo of the semiconductor laser 12 is shown by an equation 1. ΔILD is determined by the variation amount of the inter-terminal voltage of the capacitor 98*a* ΔVch_a shown by an equation 2.

$$\Delta ILD = \Delta po/\eta = 5\ \text{mW} * 0.5\% / 0.5\ \text{mW/mA} = 0.05\ \text{mA} \quad \text{(Eq. 1)}$$

$$\Delta \text{Vch_a} = \Delta ILD * Rs/\alpha = 0.05\ \text{mA} * 10\ k\Omega/100 = 0.005\ V \quad \text{(Eq. 2)}$$

In the above, it is possible to reach ΔVch_a as the capacitance of the capacitor 98*a* is smaller, which is obtained by an equation 3 by the light amount control/rising time Tr and the charging/discharging current Id.

$$\text{Capacity of capacitor } 98a = Tr * Id/\Delta Vch_a = 5\ \mu S * 1\ \mu A/0.005\ V \leq 1000\ pF \quad \text{(Eq. 3)}$$

The capacitor 98*b* holds the voltage Vch_b controlled by the second light amount control mode. The driving current of the semiconductor laser 12 is determined by an inter-terminal voltage of the capacitor 98*b*. To satisfy the second target value, variation amount of an inter-terminal voltage of the capacitor 98*b* ΔVch_b needs to be a value below that obtained by the equation 2.

The variation amount ΔVch_b is generated by the leak current I_leak of the laser driver 30 and the time T2 for the image forming mode during which the capacitor 98*b* accumulates charge. It is possible to suppress ΔVch_b as the capacitance of the capacitor 98*b* is larger, which is obtained by an equation 4 by the time T2 for the image forming mode and the leak current I_leak.

$$\text{Capacity of capacitor } 98b = T2 * I_\text{leak}/\Delta Vch_b = 500\ \mu S * 0.1\ \mu A/0.005\ V\ 0.01\ \mu F \quad \text{(Eq. 4)}$$

In this manner, the capacitance of the capacitor 98*a* selected in the first light amount control mode needs to make it smaller than that of the capacitor 98*b* selected in the second light amount control mode. As mentioned, by setting the capacitance of the capacitor 98*a* and the capacitor 98*b*, it is possible to set the rising time Tr below 5 μS at the first light amount control mode and set the light amount variation rate ΔPo below 0.5% at the image forming mode.

The image forming apparatus of the present embodiment switches two capacitors 98*a* and 98*b*. Thereby, to execute each light amount control mode, it is possible to control the voltage of each capacitor based on the voltage controlled in the same light amount control mode of the previous scanning period. Thereby, it is possible to suppress increase of light amount control time.

(Embodiment 4)

Figure 12:
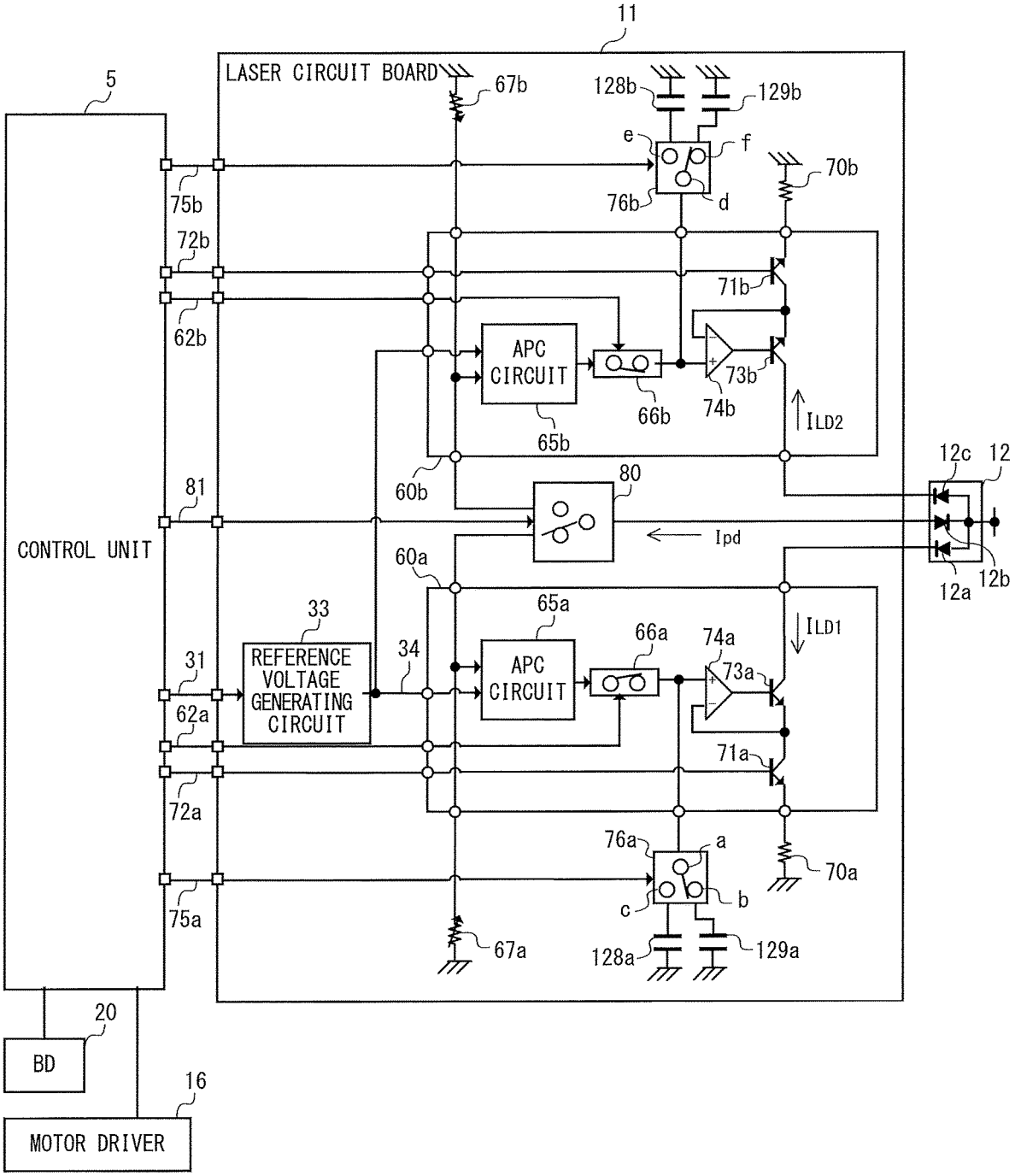
FIG. 12 is another configuration diagram of a laser circuit board according to an Embodiment 4.

FIG. 12 is other configuration diagram of the laser circuit board 11. The laser circuit board 11 of the Embodiment 3 performs light emission control of a plurality of light emitting elements LD 12*a* and LD 12*c* which respectively emit light. The laser circuit board 11 of the Embodiment 4 has almost the same configuration as that of the laser circuit board 11 of the Embodiment 2 shown in FIG. 6. Instead of the capacitor 68*a*, the laser circuit board 11 of the present embodiment comprises a capacitor 128*a*, a capacitor 129*a*, and a switch 76*a*. Instead of the capacitor 68*b*, the laser circuit board 11 of the present embodiment comprises a capacitor 128*b* and, a capacitor 129*b*, and a switch 76*b*.

Figure 13A:
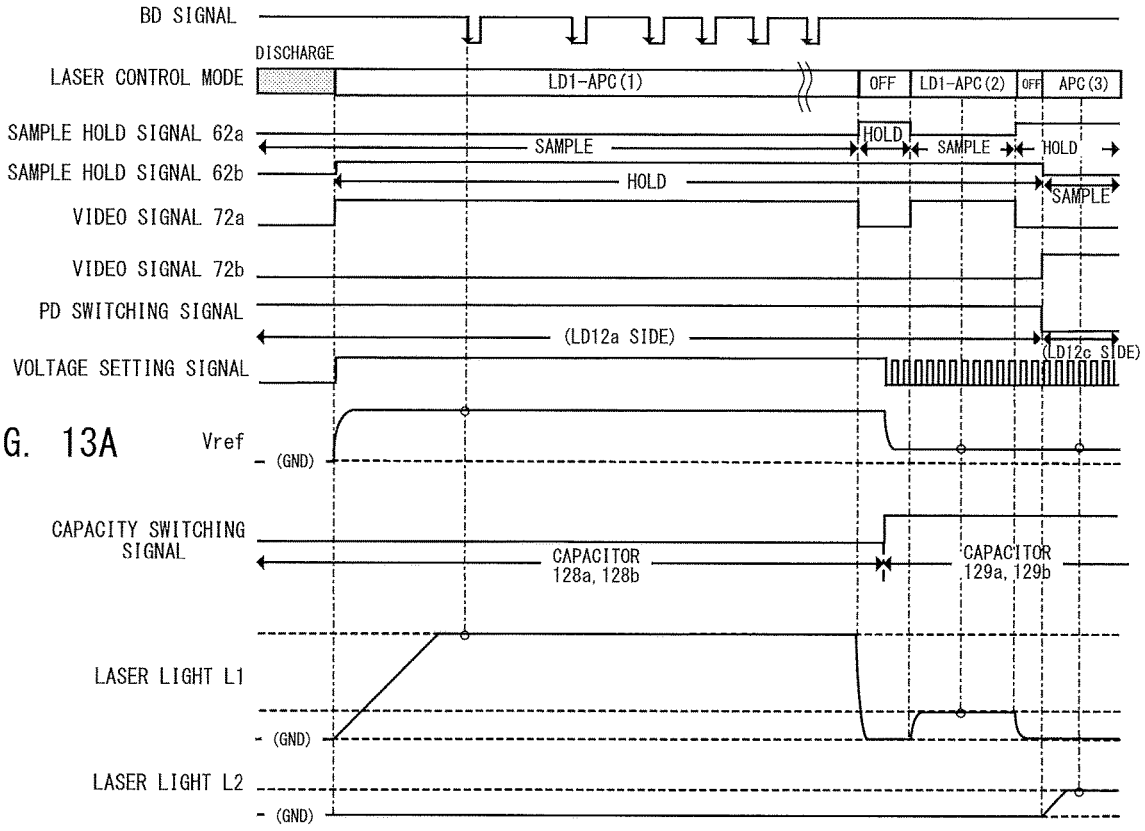
FIGS. 13A and 13B are timing charts of light emission control of semiconductor laser by a laser circuit board according to the Embodiment 4.
Figure 13B:
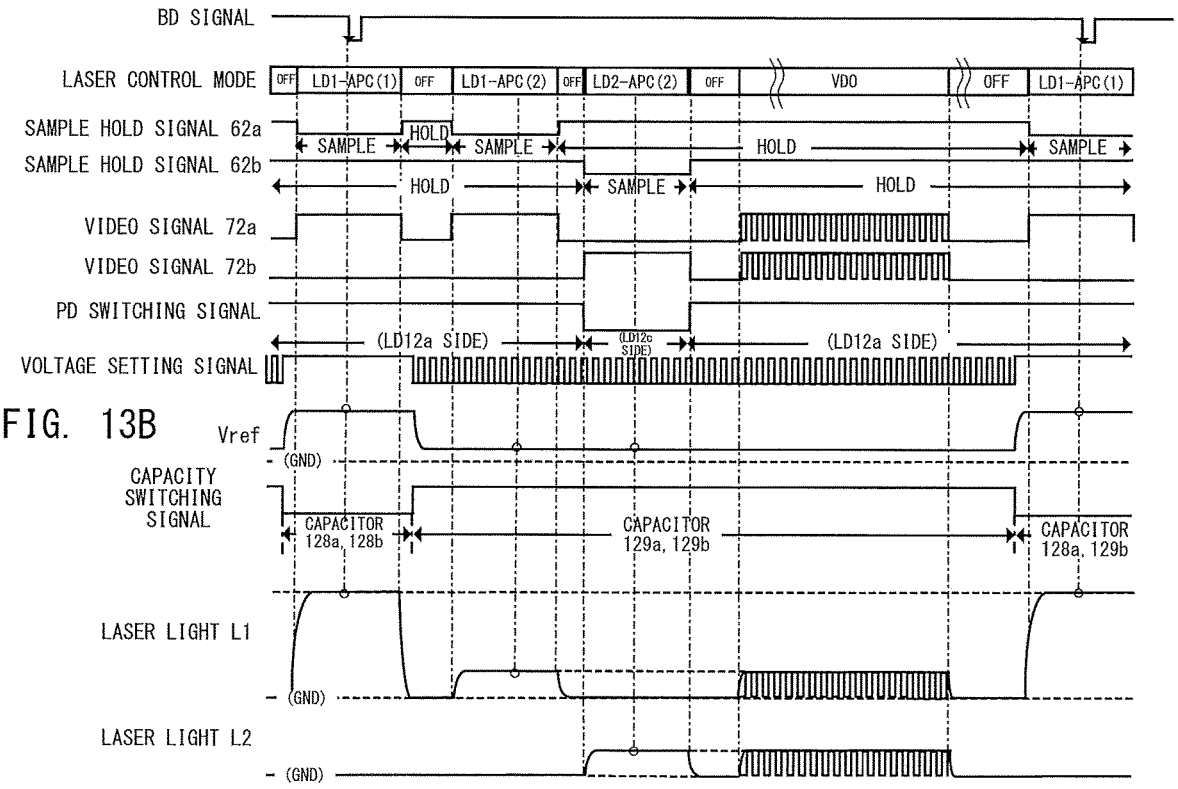

FIGS. 13A and 13B are timing charts showing a control state of the laser circuit board 11 as shown in FIG. 12A. FIG. 13A represents a timing chart when starting up the optical scanning apparatus 2*a*. FIG. 13B represents a timing chart of one scanning period of the laser light during the image formation of one line. Following FIG. 13A, processing in accordance with the timing chart of FIG. 13B is executed. In response to the sample hold signals 62*a* and 62*b* and the video signals 72*a* and 72*b* which are input from the control unit 5, the laser circuit board 11 performs light emission control of the semiconductor laser 12 with the falling of the BD signal as a starting point. The image forming apparatus 1 of the present embodiment generates the BD signal 21 by making the laser light L1 emitted from the LD 12*a* incident on the BD 20. The laser light L2 emitted from the LD 12*c* does not contribute to the generation of the BD signal 21. FIGS. 13A and 13B are timing charts based on the BD signal 21 which is output by receiving, by the BD 20, the laser light L1 output from the LD 12*a*. The control state of the laser drivers 60*a* and 60*b* is determined with the falling of the BD signal 21 as a start point.

Before starting up the optical scanning apparatus 2*a*, the control unit 5 sets the control mode of the laser drivers 60*a* and 6*b* in the stop (DISCHARGE) mode. In the DISCHARGE mode, no charge is accumulated in the capacitor 128*a*, the capacitor 128*b*, and the capacitor 129*b*.

By the input of the image data into the image forming apparatus 1, the control unit 5 transmits the acceleration signal to the motor driver 16 to start the rotation of the polygon mirror 15*a* of the optical scanning apparatus 2*a*. When starting up the optical scanning apparatus 2*a*, the control unit 5 sets the control mode of the laser driver 60*a* in the first light amount control mode (LD1-APC(1)). While the first light amount control mode is being executed, the laser driver 60*b* turns to the OFF mode. Further, the OFF mode shown in FIGS. 13A and 13B shows that both the laser drivers 60*a* and 60*b* turn to the OFF mode. In the OFF mode, the control unit 5 outputs the video signals 72*a* and 72*b* of Low level. Due to this, the transistors 71*a* and 71*b* turn to the OFF state. Thereby, no current $I_{LD1}$ flows in the LD 12*a*. Also, no current $I_{LD2}$ flows in the LD 12*c*.

In the first light amount control mode (LD1-APC(1)), the control unit 5 sets the video signal 72*a* to the High level and sets the video signal 72*b* to the Low level. Due to this, the transistor 71*a* turns to the ON state and the transistor 71*b* turns to the OFF state. Further, in the first light amount control mode, the control unit 5 outputs the voltage setting signal 31 with the duty ratio of 100%. Further, in the first light amount control mode, the control unit 5 outputs the PD switching signal 81 of High level to connect the PD 12*b* with the resistor 67*a*. Also, by outputting the sample hold signal 62*b* of Low level, the control unit 5 connects the switch 66*a* (sample state). At this time, the sample hold signal 62*b* is in the High level and the switch 66*b* is in the non-connected state (hold state).

In the first light amount control mode, the laser driver 60*a* gradually charges the capacitor 128*a* to decrease the difference between the reference voltage Vref 34 in which the voltage setting signal 31 with the duty ratio of 100% is smoothed and the terminal voltage $V_{pd1}$ of a side to which the resistor 67*a* is not grounded. In accordance with the increase of the voltage of the capacitor 128*a*, the light amount of the laser light L1 emitted from the LD 12*a* increases. By the increase of the light amount of the laser light L1 emitted from the LD 12*a* to some extent, the light receiving signal which is output from the BD 20 exceeds the threshold. Thereby, the BD signal 21 is generated. Thereafter, the laser driver 60*a* controls the voltage of the capacitor 128*a* until the reference voltage Vref 34 becomes equal to the terminal voltage $V_{pd1}$. When the BD 20 detects the laser the light L1 predetermined number of times and outputs the BD signal 21 predetermined number of times, the laser control mode turns to the second light amount control mode (LD1-APC(2)). The optical scanning apparatus 2*a* performs the light emission control in forming the image of one line (FIG. 13B).

When the BD signal 21 is generated in a target period, the control unit 5 starts the image formation. In the following, a description is provided, using FIG. 13B, with regard to the control mode set in the laser driver 60*a* during the image formation. The control mode is set in the laser driver 60*b* in a similar manner. After the first light amount control mode shown in FIG. 13B, the control unit 5 switches the laser driver 60*a* from the first light amount control mode to the OFF mode at timing based on the BD signal 21 (see FIG. 13B). Thereafter, the control unit 5 switches the control mode of the laser driver 60*a* from the OFF mode to the second light amount control mode (LD1-APC(2)) at timing based on the BD signal 21. While the second light amount control mode is being set, the laser driver 60*b* turns to the OFF mode.

In the second light amount control mode (LD1-APC(2)), the control unit 5 sets the video signal 72*a* to the High level and sets the video signal 72*b* to the Low level. Due to this, the transistor 71*a* turns to the ON state and the transistor 71*b* turns to the OFF state. Further, in the second light amount control mode, the control unit 5 outputs the voltage setting signal 31 with the duty ratio of 25% to the laser circuit board 11. Due to this, the value of the reference voltage Vref 34 is reduced by ¼ as compared to that when the duty ratio of the voltage setting signal 31 is 100%. The light amount of the laser light emitted from the semiconductor laser 12 is accordingly reduced by ¼ as compared to that when the duty ratio of the voltage setting signal 31 is 100%.

Further, in the second light amount control mode, the control unit 5 outputs the PD switching signal 81 of High level to connect the PD 12*b* with the resistor 67*a*. Also, by outputting the sample hold signal 62*b* of Low level, the control unit 5 connects the switch 66*a* (sample state). At this time, the sample hold signal 62*b* is in the High level and the switch 66*b* is in the non-connected state (hold state).

In the second light amount control mode, the laser driver 60*a* compares the reference voltage Vref 34 in which the voltage setting signal 31 with the duty ratio of 25% is smoothed with the terminal voltage $V_{pd1}$ of a side to which the resistor 67*a* is not grounded. The laser driver 60*a* controls the voltage of the capacitor 128 so that the reference voltage Vref 34 becomes equal to the voltage $V_{pd1}$. The current $I_{LD1}$ based on the voltage which is controlled here is supplied to the LD 12*a* during scanning the photosensitive drum 25.

Thereafter, the control unit 5 switches the laser driver 60*a* from the second light amount control mode to the OFF mode at timing based on the BD signal 21 (see FIG. 13B). Then, the control unit 5 switches the laser driver 60*b* from the OFF mode to the third light amount control mode (LD2-APC(2)).

In the third light amount control mode (LD2-APC(2)), the control unit 5 sets the video signal 72*a* to the Low level and sets the video signal 72*b* to the High level. Due to this, the transistor 71*a* turns to the OFF state and the transistor 71*b* turns to the ON state. Further, in the third light amount control mode, the control unit 5 outputs the voltage setting signal 31 with the duty ratio of 25% to the laser circuit board 11. Due to this, the value of the reference voltage Vref 34 is reduced by ¼ as compared to that when the duty ratio of the voltage setting signal 31 is 100%. The light amount of the laser light emitted from the semiconductor laser 12 is accordingly reduced by ¼ as compared to that when the duty ratio of the voltage setting signal 31 is 100%.

In the third light amount control mode, the control unit 5 outputs the PD switching signal 81 of Low level to connect the PD 12*b* with the resistor 67*b*. Also, by outputting the sample hold signal 62*b* of High level, the control unit 5 connects the switch 66*b* (sample state). At this time, the sample hold signal 62*a* is in the Low level and the switch 66*b* is in the non-connected state (hold state).

In the third light amount control mode, the laser driver 60*a* compares the reference voltage Vref 34 in which the voltage setting signal 31 with the duty ratio of 25% is smoothed with the terminal voltage $V_{pd2}$ of a side to which the resistor 67*a* is not grounded. Thereafter, the laser driver 60*a* controls the voltage of the capacitor 128*b* so that the reference voltage Vref 34 becomes equal to the voltage $V_{pd2}$. The current $I_{LD2}$ based on the voltage which is controlled here is supplied to the LD 12*c* during scanning the photosensitive drum 25.

As shown in FIG. 13B, the image forming apparatus 1 of the present embodiment separately performs the first light amount control mode, the second light amount control mode, and the third light amount control mode one time during one scanning period of the laser light. Through the first light amount control mode, the image forming apparatus 1 controls the laser light L1 to the first target light amount. Through the second light amount control mode, the image forming apparatus 1 controls the laser light L2 to the second first target light amount. Through the third light amount control mode, the image forming apparatus 1 controls the laser light L2 to the second target light amount.

In this manner, by performing switching, by the control unit 5, of the control mode as mentioned in one scanning period, it is possible to separately control the light amount of the laser light L1 made incident on the BD 20 and the light amount of the laser light L1 and the laser light L2 which scan the photosensitive drum 25. Due to this, it is possible to control the light amount of the laser light L1 made incident on the BD 20 and the light amount of the laser light L1 and the laser light L2 which expose the photosensitive drum 25 with high accuracy. The light amount of the laser light L1 made incident on the BD is controlled substantially constant regardless of the light amount of the laser light which exposes the photosensitive drum 25. Thereby, regardless of the light amount of the laser light which exposes the photosensitive drum 25, it is possible to define a writing start position of the image in a main scanning direction substantially constant.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-163243, filed Aug. 20, 2015, and No. 2015-178666, filed Sep. 10, 2015 which are hereby incorporated by reference herein in their entirety.

What is claimed is:

1. An image forming apparatus comprising:

a photoreceptor;

a light emitting element configured to emit laser light of a light amount corresponding to a value of current supplied;

a first light receiving element configured to receive laser light emitted from the light emitting element to generate a light receiving signal corresponding to a light amount of the laser light received by the first light receiving element;

a deflection unit configured to deflect the laser light emitted from the light emitting element such that the laser light deflected by the deflection unit scans the photoreceptor;

a second light receiving element arranged on a scanning path of the laser light deflected by the deflection unit and configured to generate a synchronization signal by receiving the laser light deflected by the deflection unit;

a timing control unit configured to control emitting timing of the laser light based on an image data in one scanning period of the laser light based on a generation timing of the synchronization signal;

an output unit configured to output a first reference voltage during the one scanning period of the laser light, and, after completing outputting of the first reference voltage, to output a second reference voltage;

a voltage control unit configured to control a voltage based on the light receiving signal and the first reference voltage for controlling a light amount of the laser light which is incident on the second light receiving element, and configured to control a voltage based on the light receiving signal and the second reference voltage for controlling a light amount of the laser light which scans the photoreceptor; and a current supply unit configured to supply current of which a value corresponds to the voltage of the voltage control unit, wherein a value of the first reference voltage is higher than a value of the second reference voltage.

2. An image forming apparatus comprising:

a photoreceptor;

a light emitting element configured to emit laser light of a light amount corresponding to a value of current supplied;

a first light receiving element configured to receive laser light emitted from the light emitting element to generate a light receiving signal corresponding to a light amount of the laser light received by the first light receiving element;

a deflection unit configured to deflect the laser light emitted from the light emitting element such that the laser light deflected by the deflection unit scans the photoreceptor;

a second light receiving element arranged on a scanning path of the laser light deflected by the deflection unit and configured to generate a synchronization signal by receiving the laser light deflected by the deflection unit;

a controller configured to control emitting timing of the laser light based on an image data in one scanning period of the laser light based on a generation timing of the synchronization signal, and configured to output a first reference voltage during the one scanning period of the laser light, and, after completing outputting of the first reference voltage, to output a second reference voltage; and a driver configured to control a voltage based on the light receiving signal and the first reference voltage for controlling a light amount of the laser light which is incident on the second light receiving element, and configured to control a voltage based on the light receiving signal and the second reference voltage for controlling a light amount of the laser light which scans the photoreceptor, and to supply a current of which a value corresponds to the voltage of the driver, wherein a value of the first reference voltage is higher than a value of the second reference voltage.

3. An image forming apparatus comprising:

a photoreceptor;

a light emitting element configured to emit laser light of a light amount corresponding to a value of current supplied;

a first light receiving element configured to receive laser light emitted from the light emitting element to generate a light receiving signal corresponding to a light amount of the laser light received by the first light receiving element;

a deflection unit configured to deflect the laser light emitted from the light emitting element such that the laser light deflected by the deflection unit scans the photoreceptor;

a second light receiving element arranged on a scanning path of the laser light deflected by the deflection unit and configured to generate a synchronization signal by receiving the laser light deflected by the deflection unit;

a timing control unit configured to control emitting timing of the laser light based on an image data in one scanning period of the laser light based on a generation timing of the synchronization signal;

an output unit configured to output a first reference voltage during the one scanning period of the laser light, and, after completing outputting of the first reference voltage, to output a second reference voltage;

a capacitor;

a voltage control unit configured to control a voltage of the capacitor based on the light receiving signal and the first reference voltage so as to control a light amount of the laser light which is incident on the second light receiving element, and configured to control a voltage based on the light receiving signal and the second reference voltage so as to control a light amount of the laser light which scans the photoreceptor; and a current supply unit configured to supply current of which a value corresponds to the voltage of the voltage control unit.

4. The image forming apparatus according to claim 3, wherein a value of the first reference voltage is higher than a value of the second reference voltage.

5. The image forming apparatus according to claim 3, wherein the voltage control unit is configured to compare the voltage of the light receiving signal with the first reference voltage or the second reference voltage and is configured to control the voltage of the capacitor.

6. The image forming apparatus according to claim 3, wherein the capacitor is operable to hold a voltage which is controlled by the voltage control unit based on the light receiving signal and the first reference voltage.

7. The image forming apparatus according to claim 3, wherein the first reference voltage is output, before incidence of the laser light into the second light receiving element, by the output unit and is used for controlling the voltage of the capacitor, and the second reference voltage is used for controlling the voltage of the capacitor after the incidence of the laser light into the second light receiving element and before scanning photoreceptor.

8. The image forming apparatus according to claim 3, wherein the first reference voltage is output, after scanning of the photoreceptor by the laser light and incidence of the laser light into the second light receiving element, by the output unit in order to control the voltage of the capacitor.

9. An image forming apparatus comprising:

a photoreceptor;

a light emitting element configured to emit laser light of a light amount corresponding to a value of current supplied;

a first light receiving element configured to receive laser light emitted from the light emitting element to generate a light receiving signal corresponding to a light amount of the laser light received by the first light receiving element;

a deflection unit configured to deflect the laser light emitted from the light emitting element such that the laser light deflected by the deflection unit scans the photoreceptor;

a second light receiving element arranged on a scanning path of the laser light deflected by the deflection unit and configured to generate a synchronization signal by receiving the laser light deflected by the deflection unit;

a controller configured to control emitting timing of the laser light based on an image data in one scanning period of the laser light based on a generation timing of the synchronization signal, and configured to output a first reference voltage during the one scanning period of the laser light, and, after completing outputting of the first reference voltage, to output a second reference voltage;

a capacitor; and a driver configured to control a voltage of the capacitor based on the light receiving signal and the first reference voltage so as to control a light amount of the laser light which is incident on the second light receiving element, and configured to control a voltage based on the light receiving signal and the second reference voltage so as to control a light amount of the laser light which scans the photoreceptor, and to supply a current of which a value corresponds to the voltage of the driver.

10. The image forming apparatus according to claim 9, wherein a value of the first reference voltage is higher than a value of the second reference voltage.

11. The image forming apparatus according to claim 9, wherein the driver is configured to compare the voltage of the light receiving signal with the first reference voltage or the second reference voltage and is configured to control the voltage of the capacitor.

12. The image forming apparatus according to claim 9, wherein the capacitor is operable to hold a voltage which is controlled by the driver based on the light receiving signal and the first reference voltage.

13. The image forming apparatus according to claim 9, wherein the first reference voltage is output, before incidence of the laser light into the second light receiving element, by the output unit and is used for controlling the voltage of the capacitor, and the second reference voltage is used for controlling the voltage of the capacitor after the incidence of the laser light into the second light receiving element and before scanning photoreceptor.

14. The image forming apparatus according to claim 9, wherein the first reference voltage is output, after scanning of the photoreceptor by the laser light and incidence of the laser light into the second light receiving element, by the output unit in order to control the voltage of the capacitor.

* * * * *